US007823250B2

(12) United States Patent
Vander Baan

(10) Patent No.: US 7,823,250 B2
(45) Date of Patent: Nov. 2, 2010

(54) BARE FLOOR CLEANER

(75) Inventor: Gabriel S. Vander Baan, Hong Kong (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 1292 days.

(21) Appl. No.: 10/711,117

(22) Filed: Aug. 25, 2004

(65) Prior Publication Data

US 2008/0092325 A1 Apr. 24, 2008

Related U.S. Application Data

(60) Provisional application No. 60/521,254, filed on Mar. 19, 2004, provisional application No. 60/498,094, filed on Aug. 26, 2003.

(51) Int. Cl.
*A47L 7/00* (2006.01)

(52) U.S. Cl. ..... 15/321; 15/328; 15/320; 15/373; 15/377

(58) Field of Classification Search ..... 15/321, 15/320, 410, 355, 324, 353
See application file for complete search history.

(56) References Cited

U.S. PATENT DOCUMENTS

| | | | | |
|---|---|---|---|---|
| 1,596,041 | A | 8/1926 | Young | |
| 2,622,254 | A | 12/1952 | Mendelson | |
| 2,635,278 | A | 4/1953 | Belknap | |
| 3,079,626 | A | 3/1963 | Yonkers et al. | |
| 3,460,187 | A | 8/1969 | Fillery | |
| 3,540,072 | A | 11/1970 | Wolter et al. | |
| 3,942,215 | A | 3/1976 | Olds | |
| 4,167,799 | A | 9/1979 | Webb | |
| 4,349,935 | A | 9/1982 | Knestele | |
| 5,465,456 | A | 11/1995 | Fellhauer et al. | |
| 6,101,668 | A | 8/2000 | Grey | |
| 6,131,237 | A * | 10/2000 | Kasper et al. | 15/320 |
| 6,158,081 | A * | 12/2000 | Kasen et al. | 15/320 |
| 6,167,587 | B1 * | 1/2001 | Kasper et al. | 15/320 |
| 6,192,548 | B1 * | 2/2001 | Huffman | 15/320 |
| 6,230,362 | B1 * | 5/2001 | Kasper et al. | 15/320 |
| 6,286,181 | B1 * | 9/2001 | Kasper et al. | 15/320 |
| 6,401,294 | B2 * | 6/2002 | Kasper | 15/320 |

(Continued)

FOREIGN PATENT DOCUMENTS

| | | |
|---|---|---|
| EP | 1027855 A2 | 8/2000 |

(Continued)

*Primary Examiner*—Lee D Wilson
(74) *Attorney, Agent, or Firm*—McGarry Bair PC

(57) ABSTRACT

The invention relates to a bare floor cleaner capable of wet pickup through a first nozzle opening with the aid of a squeegee, wet scrubbing with an agitator, and dry pickup through a second nozzle opening. The bare floor cleaner comprises a dual-path nozzle assembly having a wet suction path in communication with the first nozzle opening and a dry suction path in communication with the second nozzle opening. A diverter valve selectively controls fluid communication between a suction source and one of the first and second nozzle openings for conversion between wet and dry modes. The bare floor cleaner further comprises a single actuator that controls the positions of the agitator and of the diverter valve. As a result, the cleaning mode of the bare floor cleaner can be controlled with a single switch that is preferably located on the handle assembly for convenient access by a user.

20 Claims, 25 Drawing Sheets

U.S. PATENT DOCUMENTS

| | | | | |
|---|---|---|---|---|
| 6,412,141 | B2 * | 7/2002 | Kasper et al. | 15/320 |
| 6,438,793 | B1 * | 8/2002 | Miner et al. | 15/320 |
| 6,467,122 | B2 | 10/2002 | Lenkiewicz et al. | |
| 2001/0022010 | A1 * | 9/2001 | Kasper | 15/320 |
| 2003/0051301 | A1 | 3/2003 | Morgan et al. | |
| 2003/0051306 | A1 | 3/2003 | Morgan et al. | |
| 2003/0051308 | A1 | 3/2003 | Morgan et al. | |
| 2003/0051309 | A1 | 3/2003 | Morgan et al. | |
| 2003/0051310 | A1 | 3/2003 | Morgan et al. | |

FOREIGN PATENT DOCUMENTS

| | | |
|---|---|---|
| GB | 2 322 066 A | 8/1998 |

* cited by examiner

BARE FLOOR CLEANER

CROSS-REFERENCE TO RELATED APPLICATIONS

This application claims the benefit of U.S. Patent Application No. 60/521,254, filed Mar. 19, 2004, and U.S. Patent Application No. 60/498,094, filed Aug. 26, 2003.

FIELD OF THE INVENTION

The invention relates to a bare floor cleaner. In one aspect, the invention relates to a bare floor cleaner that is capable of wet pickup through a first nozzle opening with the aid of a squeegee. In another aspect, the invention relates to a bare floor cleaner that is capable of wet scrubbing with an agitator, with or without wet pickup. In yet another aspect, the invention relates to a bare floor cleaner that is capable of dry pickup through a second nozzle opening.

DESCRIPTION OF THE RELATED ART

The common procedure of cleaning a bare floor surface, such as tile, linoleum, and hardwood floors, involves several steps. First, dry or loose dust, dirt, and debris are removed, followed by applying liquid cleaning solution to the surface either directly or by means of an agitator. Motion of the agitator with respect to the bare surface loosens the remaining dirt. If the agitator is absorbent, it will remove the dirt and collect a portion of the soiled cleaning solution from the floor; otherwise, the dirt and soiled cleaning solution must be removed by another means. Finally, the remaining soiled cleaning solution on the surface is commonly left to air dry, and the duration of time required for the bare surface to completely dry depends on the amount of residual solution on the floor. During this period, it is best to avoid foot traffic in the area because dirt and debris easily adheres to a wet surface.

Washing a bare floor is commonly accomplished with multiple cleaning tools. For example, the first step of removing dry particles most often employs a conventional broom and dustpan. However, when sweeping dirt from a pile into the dustpan, it is difficult to transfer the entire pile. As a result, a portion of pile tends to remain on the floor. Additionally, a user must bend over to hold the dustpan in place while collecting the dirt pile. Such motion can be inconvenient, difficult, and even painful for some users. Dust cloths can also be used, but large dirt particles do not sufficiently adhere thereto. Another option is vacuuming the dry dirt, but most homes are equipped with vacuum cleaners that are designed for use on carpets and can damage bare surfaces.

Tools for applying and/or agitating cleaning solution have similar deficiencies. The most common cleaning implement for these steps is the traditional sponge or rag mop. Mops are capable of loosening dirt from the floor and have excellent absorbency. When the mop requires cleaning solution, it is placed in a bucket to soak up warm cleaning solution and returned to the floor. Each time, the mop is usually placed in the same bucket, and after several repetitions, the cleaning solution becomes dirty and cold. As a result, spent cleaning solution is used to remove dirt from the bare surface. Furthermore, movement of the mop requires physical exertion, and the mop head wears with use and must be replaced periodically. A textured cloth can also be used as an agitator, but it also requires physical exertion and regular replacement. Additionally, cloths are not as absorbent as mops and, therefore, can leave more soiled cleaning solution on the floor.

Household cleaning devices have been developed to eliminate the need for multiple cleaning implements for washing a bare floor and alleviate some of the problems described above that are associated with the individual tools. Such household devices are usually adapted for vacuuming or sweeping dry dirt and dust prior to application of cleaning solution, applying and agitating the cleaning solution, and, subsequently, vacuuming the soiled cleaning solution, thereby leaving only a small amount of cleaning solution on the bare surface. Common agitators are rotating brushes, rotating mop cloths, and stationary or vibrating sponge mops. A good portion of the multifunctional cleaning devices utilizes an accessory that is attached to the machine to convert between dry and wet cleaning modes. Others are capable of performing all of the functions without accessories but have complex designs and features that can be difficult and confusing to operate.

Examples of multi-functional bare floor cleaners are disclosed in U.S. Pat. Nos. 2,622,254 and 6,101,668 and in U.S. Patent Application Publication Nos. 2003/0051301, 2003/0051306, 2003/0051308, 2003/0051309, and 2003/00513010. U.S. Pat. No. 2,622,254 discloses an apparatus for cleaning bare and carpeted floors and comprises several independently adjustable cleaning implements, such as a squeegee attached to a suction pipe, a scrubbing roll, and a sweeping roll. The apparatus can accomplish wet pickup through the suction pipe, wet scrubbing by means of the scrubbing roll, and dry pickup with a dust collecting nozzle disposed adjacent the sweeping roll.

The above listed family of patent application publications discloses a bare floor cleaner having independently adjustable nozzle and brush assemblies. The nozzle assembly comprises a single nozzle opening that is surrounded by an overmolded squeegee and through which both wet and dry debris can enter. The cleaner operates in a wet pickup mode with the nozzle assembly in contact with the surface to be cleaned. The nozzle assembly is raised to a position above the surface to be cleaned for operation in a dry pickup mode.

U.S. Pat. No. 6,101,668 is an example of a cleaner that can accomplish all the steps required to clean a bare floor with the assistance of an attachment. The cleaner has a cleaning head equipped with a nozzle having squeegees on the front and rear sides thereof and a vertically adjustable scrubbing pad through which cleaning solution can be dispensed. When a cover is attached to the bottom of the cleaning head, the entire cleaning head, including the squeegees, nozzle, and pad, are raised from the floor to permit dry pickup.

SUMMARY OF THE INVENTION

The invention relates to a floor cleaner capable of cleaning both wet and dry floor surfaces and comprises a base having a dry suction opening and a wet suction opening, a handle pivotally connected to the base, a recovery tank mounted to one of the handle and the base, a working air conduit extending from each of the dry suction opening and the wet suction opening to the recovery tank, a motor/fan assembly mounted to one of the handle and the base and adapted to create a working air flow in the working air conduit from at least one of the dry floor suction opening and the wet floor suction opening and to the recovery tank and a diverter mounted in the working air conduit and movable between a dry suction position and a wet suction position for selectively at least partially blocking working air flow from the dry suction opening and the wet suction opening, respectively, to the recovery tank. According to the invention, an actuator is mounted on at least one of the handle and the base and operably connected to the diverter for selectively positioning the diverter in the dry suction position and the wet suction position.

In one preferred embodiment of the invention, the actuator is adapted to simultaneously position the diverter and the agitator in preselected positions.

In another preferred embodiment of the invention, an agitator is movably mounted to the base for movement between a first position wherein the agitator is adapted to agitate a surface to be cleaned and a second position wherein the agitator is spaced from the surface to be cleaned for selectively agitating the floor surface. The actuator is operably coupled to the agitator for selectively positioning the agitator in the first position and the second position.

Preferably, the actuator is adapted to simultaneously position the diverter and the agitator in preselected positions. A control element is mounted between the actuator and the diverter and between the actuator and the agitator for moving the diverter and agitator into a first mode wherein the diverter is in the dry suction position and the agitator is in the second position, a second mode wherein the diverter is in the wet suction position and the agitator is in the first position and a third mode wherein the diverter is in the wet suction position and the agitator is in the second position. Further, the control element is adapted to control movement of the diverter and agitator into a fourth operating mode wherein the diverter is in the dry position and the agitator is in the first position.

In an illustrative embodiment, the control element comprises a diverter cam member adapted to control the position of the diverter and an agitator cam member adapted to control the position the agitator. In this embodiment, the control element comprises a wheel with two sides. The diverter cam member and the agitator cam member are disposed on opposite sides of the wheel. The actuator can connected to the control element through a pull-pull cable assembly. In a preferred embodiment, the actuator is disposed on the handle.

In another illustrative embodiment, an agitator platform is pivotally mounted to the base and mounts the agitator and the control element is operatively connected to the agitator platform for selective positioning the agitator in the first and second positions. Further, the agitator is driven by an agitator motor that is mounted on the agitator platform.

In one preferred embodiment, the recovery tank is mounted on the handle and the motor/fan assembly is mounted on the handle above the recovery tank. Further, a carry handle mounted on the handle.

In another illustrative embodiment, a supply tank is mounted to the handle for storing a supply of cleaning fluid, a dispenser is mounted to the base for dispensing cleaning fluid onto the floor surface, a supply conduit extends between the supply tank and the dispenser and a heater is mounted in the supply conduit for heating the cleaning fluid as it flows from the supply tank to the dispenser.

Still further according to the invention, a floor cleaner capable of cleaning both wet and dry floor surfaces comprises a base having a dry suction opening and a wet suction opening adapted to remove debris from a surface to be cleaned, a handle is connected to the base, a recovery tank is carried by the handle and a working air conduit extends from each of the dry suction opening and the wet suction opening to the recovery tank A motor/fan assembly is mounted to one of the handle and the base and is adapted to create a working air flow in the working air conduit from at least one of the dry floor suction opening and the wet floor suction opening and to the recovery tank. A diverter is mounted in the working air conduit and is movable between a dry suction position and a wet suction position for selectively at least partially blocking working air flow from the wet suction opening and the dry suction opening, respectively, to the recovery tank. An actuator is mounted on the handle of the base and is operably connected to the diverter for selectively positioning the diverter in the dry suction position and the wet suction position.

In a preferred embodiment, the motor/fan assembly is mounted above the recovery tank on the handle. Further, the handle is pivotally connected to the base.

In an illustrative embodiment of the invention, an agitator is mounted to the base and is movable between a first position wherein the agitator contacts the floor surface and a second position wherein the agitator is spaced from the floor surface for selectively agitating the floor surface. The actuator is operably connected to the agitator for selectively positioning the agitator between the first position and the second position.

Preferably, the actuator can simultaneously position the diverter and the agitator in preselected positions.

Still further according to the invention, a floor cleaner capable of cleaning both wet and dry floor surfaces comprises a base for movement along a floor surface to be cleaned, a nozzle assembly mounted to the base and having a dry suction conduit with a dry suction opening at one end thereof adjacent to the floor surface and a wet suction conduit with a wet suction opening at one end thereof adjacent to the floor surface and different from the dry suction opening. A handle is connected to the base and a recovery tank mounted on one of the handle and the base. A working air conduit extends from each of the dry suction opening and the wet suction opening to the recovery tank. A motor/fan assembly is mounted to the handle or the base and is adapted to create a working air flow in the working air conduit from at least one of the dry floor suction opening and the wet floor suction opening and to the recovery tank. The wet suction conduit and the dry suction conduit are vertically juxtaposed to each other.

Preferably, the wet and dry suction openings are horizontally juxtaposed to each other. Further, at least a portion of one of the wet suction conduit and the dry suction conduit is made of a translucent material so that the working air flow therethrough is visible to a user. Preferably, at least a portion of both of the wet suction conduit and the dry suction conduit are made of a translucent material so that the working air flow therethrough are visible to a user.

In a preferred embodiment, the nozzle assembly further comprises a squeegee disposed in the wet suction opening.

In a further preferred embodiment, the nozzle assembly is removably mounted to the base.

DESCRIPTION OF THE PREFERRED EMBODIMENT

The invention relates to a bare floor cleaner that is capable of wet pickup from a first nozzle opening with the aid of a squeegee and dry pickup from a second nozzle opening. The bare floor cleaner is equipped with an agitator for wet scrubbing. The invention performs all functions without adding any accessories.

Figure 1:
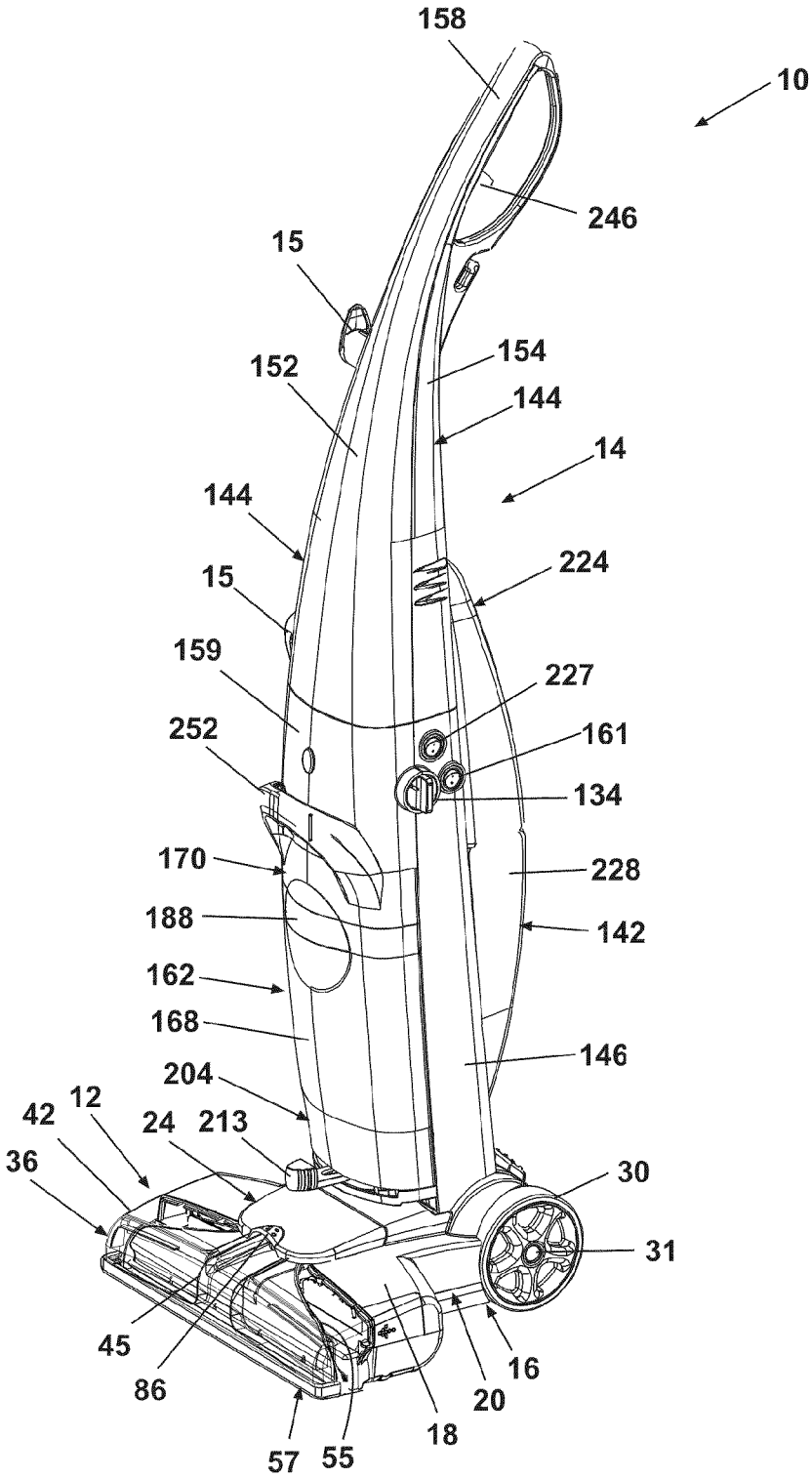
FIG. 1 is a perspective view of a bare floor cleaner having a base assembly and a handle assembly according to the invention.

Referring now to the figures, and FIG. 1 in particular, a bare floor cleaner 10 according to the invention for cleaning hard floor surfaces, such as tile, linoleum, and wood, comprises a base assembly 12 and a handle assembly 14 pivotally mounted to the base assembly 12. The handle assembly 14 houses a recovery tank assembly 162 and a cleaning solution supply tank 224 and is movable between an upright storage position and a reclined working position in which the handle assembly 14 is oriented at an angle less than 90-degrees relative to the surface to be cleaned. When the handle assembly 14 is in the working position, a user can grasp a handle grip 158 to manipulate the bare floor cleaner 10 over the surface to be cleaned. A carrying handle 252 is disposed on the handle assembly 14 for transportation of the bare floor cleaner 10 between uses. A conventional cord wrap 15 is also located on the handle assembly 14 for storage of an electrical cord (not shown) when the bare floor cleaner 10 is not in use.

Figure 2A:
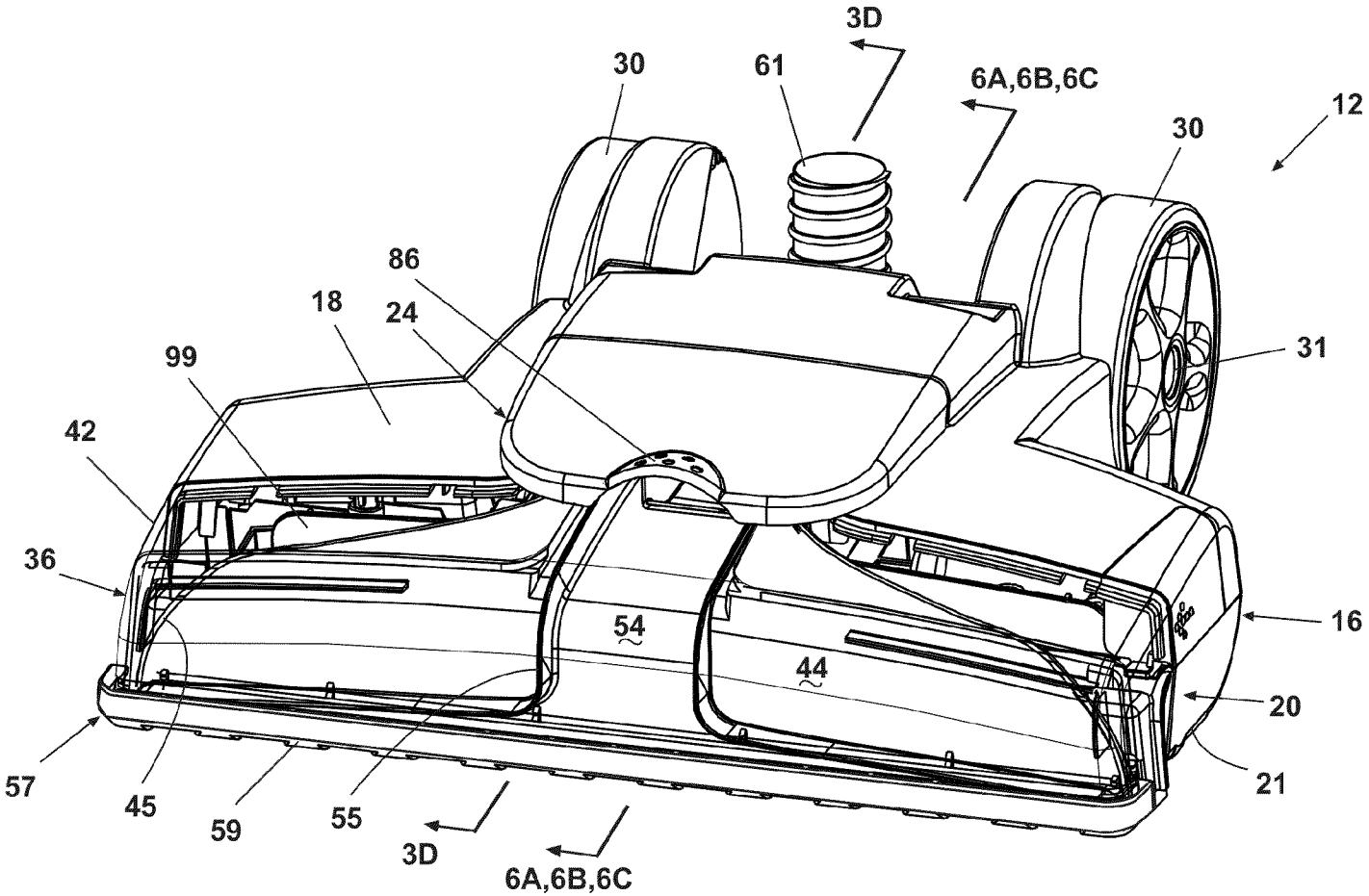
FIG. 2A is perspective view of the base assembly of the bare floor cleaner in FIG. 1, wherein a latch is in a locked position to lock a nozzle assembly to the housing of the base assembly.
Figure 2B:
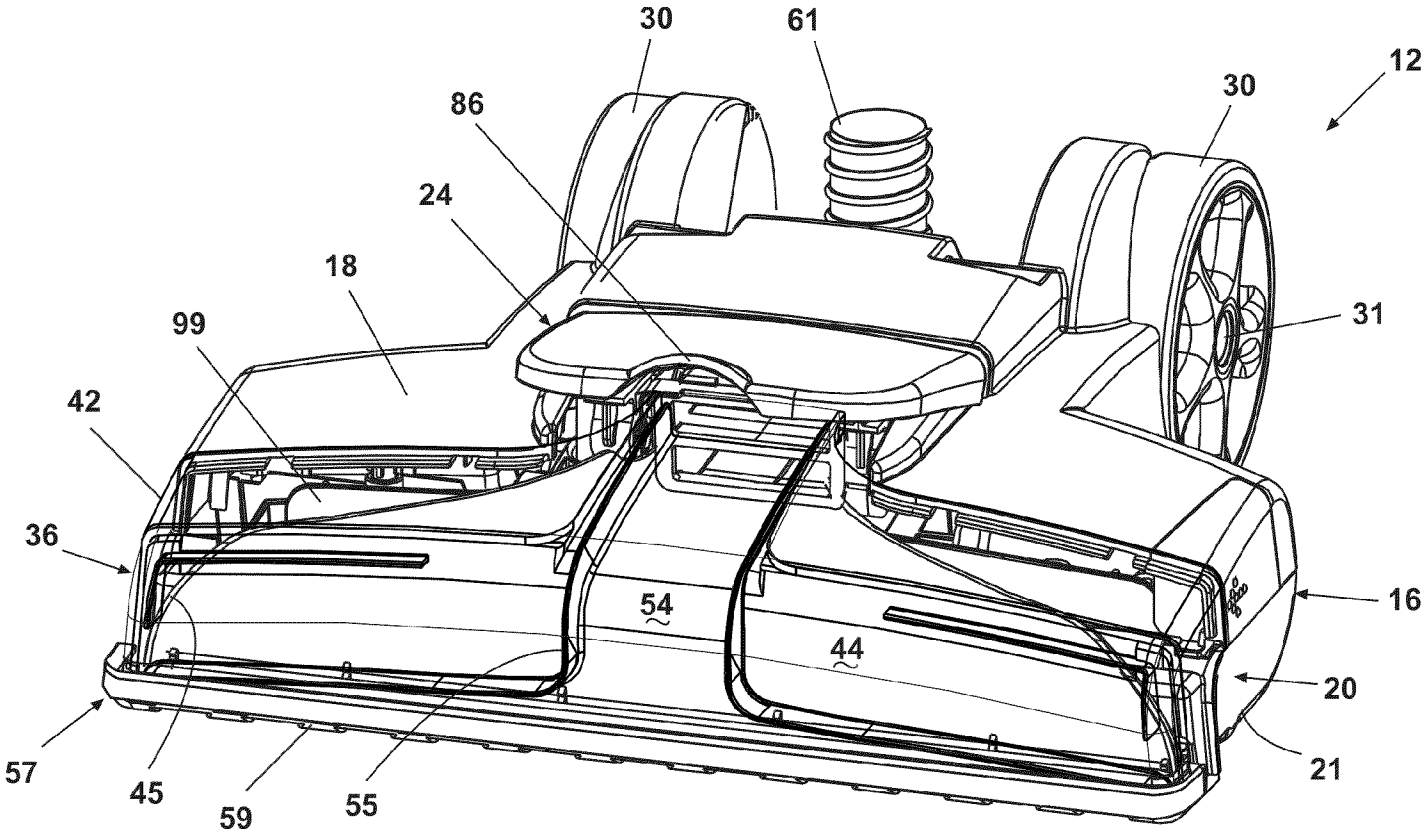
FIG. 2B is a perspective view of the base assembly in FIG. 2A, wherein the latch is in an unlocked position to facilitate removal of the nozzle assembly from the housing.
Figure 2C:
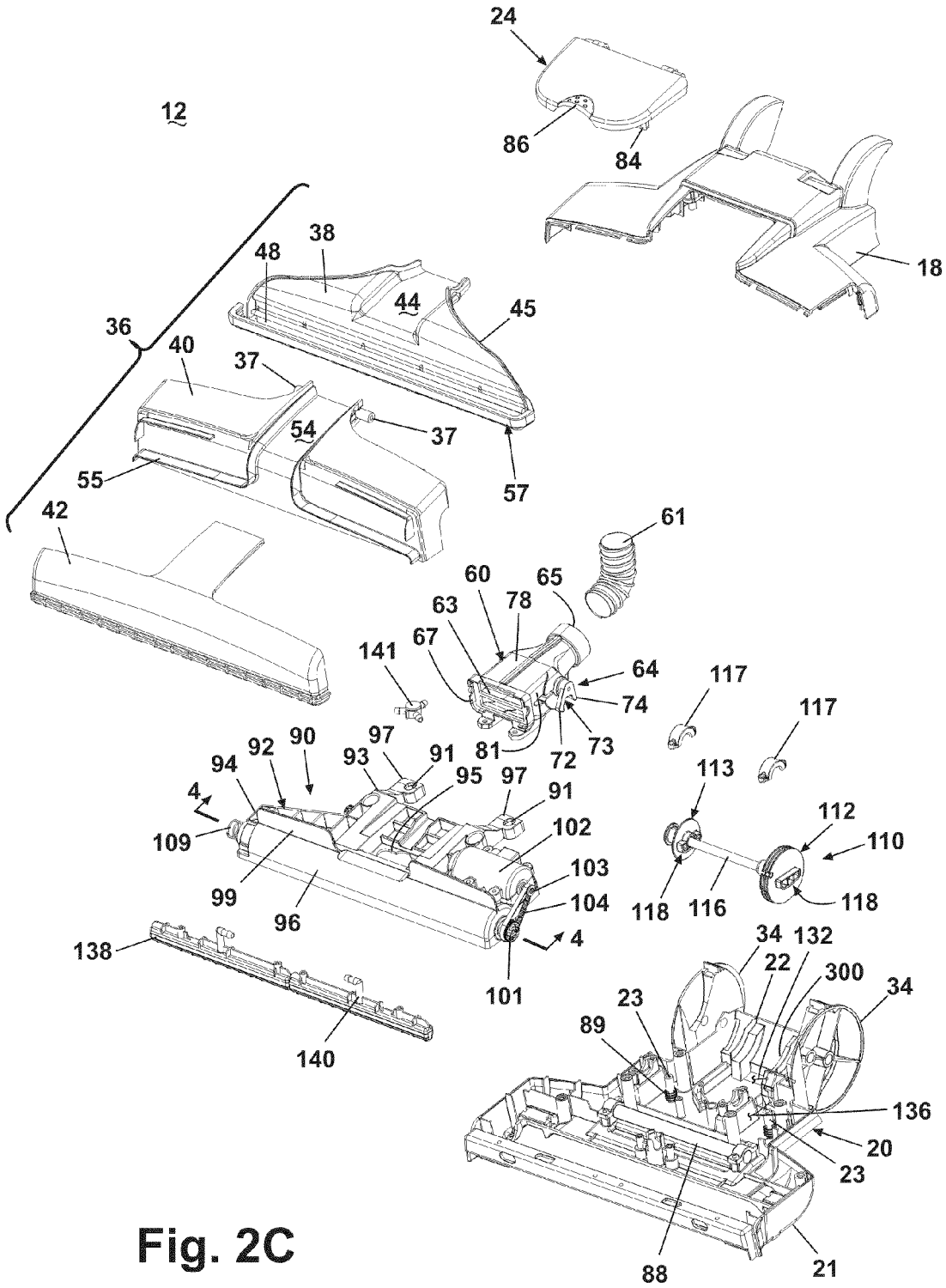
FIG. 2C is an exploded view of the base assembly in FIG. 2A.

Referring now to FIGS. 2A-2C, the base assembly 12 comprises a housing 16 having an upper cover 18 and a T-shaped base platform 20. The upper cover 18 extends from approximately the middle to the rear of the housing 16 and pivotally mounts a latch 24 for securing a dual path nozzle assembly 36 to the housing 16. The base platform 20 includes an elongated forward portion 21 and a relatively narrow rear portion 22 and comprises a plurality of upstanding bosses 23 for mounting interior components thereto. In addition to the nozzle assembly 36, the base assembly 12 supports a diverter housing 60 with a diverter valve 64 to switch between the dual paths of the nozzle assembly 36, an agitator assembly 90, a control element in the form of a cam assembly 110 in operative communication with the diverter valve 64 and with the agitator assembly 90, and a dispenser 138 for applying cleaning fluid to the surface to be cleaned.

A first pair of wheels 30 is mounted for rotation on axles 31 on opposite sides of the rear portion 22, and a second pair of smaller wheels 32 (FIG. 3D) is rotatably mounted to the forward portion 21. The wheels 30 and 32 at least partially support the base assembly 12 on the surface to be cleaned and facilitate facile movement of the bare floor cleaner 10 along the surface to be cleaned. The base platform 20 further comprises circular pivot members 34 that are disposed adjacent the first pair of wheels 30 and operably communicate with the handle assembly 14 for pivotally mounting the handle assembly 14 to the base assembly 12.

With continued reference to FIGS. 2A-2C and 3D, the dual paths of the nozzle assembly 36 are formed by a bottom wall 38, a middle wall 40, and a top wall 42. The middle and top walls 40 and 42 are preferably composed of a translucent material. A wet suction path 44 is formed between the bottom wall 38 and the middle wall 40 and has a first or wet nozzle opening 46 that extends transversely along the housing 16 adjacent the surface to be cleaned. The width of the wet suction path 44 is defined by spaced wet nozzle side walls 45 that are integral with the bottom wall 38. The wet suction path 44 tapers from the elongated first nozzle opening 46 to approximately the width of the diverter housing 60. A horizontal squeegee 48 is disposed in the center of the first nozzle opening 46 to assist in collecting fluid for suction into the wet suction path 44 and to help support the base assembly 12 on the surface to be cleaned. The squeegee 48 is fixed to the side walls 45 and can optionally comprise nubs on the ends thereof. Because the squeegee 48 is centrally positioned, fluid and dirt can enter the first nozzle opening 46 in a space between the squeegee 46 and middle wall 40 when the bare floor cleaner 10 moves forward or a space between the squeegee 48 and the bottom wall 38 when the bare floor cleaner 10 moves backwards. As a result, the bare floor cleaner 10 can perform wet pickup during both forward and rearward motion. Additionally, the first nozzle opening 46 and the wet suction path 44 are sufficiently narrow to concentrate suction forces for efficient pickup of fluid.

A dry suction path 54 overlaps the wet suction path 44 and is formed between the middle wall 40 and the top wall 42. The dry suction path 54 is in fluid communication with a second or dry nozzle opening 56 that extends transversely along the base assembly 12 parallel to and in front of the first nozzle opening 46. The width of dry suction path 54 is defined by spaced dry nozzle side walls 55 that are integral with the middle wall 40. As with the wet suction path 44, the dry suction path 54 tapers from the second nozzle opening 56 to approximately the width of the diverter housing 60. As best seen in FIGS. 2A and 2B, the dry suction path 54 tapers more rapidly than the wet suction path 44. Consequently, a significant portion of the wet suction path 44 is visible even though the dry suction path 54 overlaps the wet suction path 44. During operation, a user can see through the translucent top and middle walls 42 and 40 to observe both the dry suction path 54 and the wet suction path 44. As a result, the user can determine whether any dirt, debris, and the like is flowing or is trapped in the suction paths 44 and 54. The second nozzle opening 56 and the dry suction path 54 are appropriately sized to accomplish dry pickup and, therefore, are larger relative to the first nozzle opening 46 and the wet suction path 44 when viewed in cross-section, as in FIG. 3D. Furthermore, the top wall 42 is spaced from the surface to be cleaned to provide clearance for large particles of dirt and debris. Because of this configuration, the bare floor cleaner 10 can capture the large particles of dirt and debris through the second nozzle opening 56. The nozzle assembly 36 further comprises a resilient bumper 57 that extends forward from the bottom wall 38 and wraps around the bottom edge of the top wall 42. Preferably, the bumper 57 includes spaced downwardly extending projections 59 that define tapered openings therebetween to concentrate suction forces to facilitate effective dry pickup.

The nozzle assembly 36 further includes a pair of horizontal posts 37 (FIG. 2C) that extend in opposite directions from the wet nozzle and dry nozzle side walls 45 and 55 and are in operative communication with the latch 24, which selectively secures the nozzle assembly 36 to the housing 16. The bottom, middle, and top walls 38, 40, and 42 that together form the nozzle assembly 36 can be removed from the base assembly 12 as a single unit.

The latch 24 is a substantially planar member pivotally connected to the cover 18 of the housing 16. The latch 24 comprises a curved handle grip 86 and downwardly extending hooks 84 adapted to engage the posts 37 on the nozzle assembly 36 to retain the latch 24 in a locked position, as shown in FIG. 2A. A latch pivot (not shown) includes a detent mechanism for retaining the latch 24 in an unlocked position, as shown in FIG. 2B, wherein the latch 24 is pivoted away from the cover 18.

With continued reference to FIGS. 2A-2C, to mount the nozzle assembly 36 to the base assembly 12, the user grasps the grip 86 and lifts the latch 24 to pivot it to the upward unlocked position. The detent mechanism retains the latch 24 in the unlocked position while the nozzle assembly 36 is attached. After the nozzle assembly 36 is properly situated on the base assembly 12, the user grasps the handle grip 86 and pushes the latch 24 down towards the cover 18 to a locked position, as shown in FIG. 2A, wherein the hooks 84 engage the posts 37 to secure the nozzle assembly 36 to the base assembly 12, and the latch 24 maintains its position due to friction. To remove the nozzle assembly 36 for cleaning or other purposes, the user grasps the handle grip 86 and pivots the latch 24 from the locked position to the unlocked position, thereby spacing the hooks 84 from the posts 37. The nozzle assembly 36 is then simply pulled from the base assembly 12.

Figure 3A:
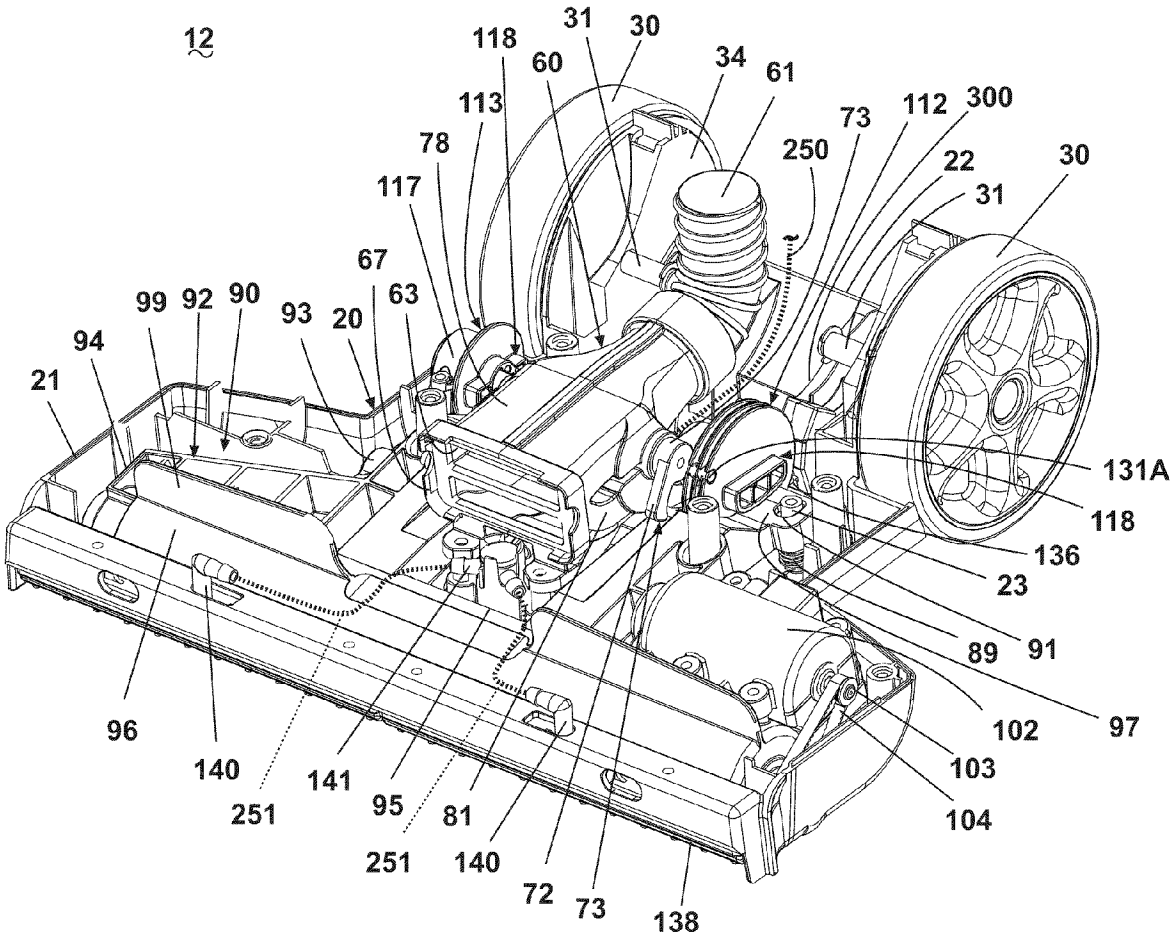
FIG. 3A is a perspective view of the base assembly in FIG. 2A with the nozzle assembly and a cover removed.
Figure 3B:
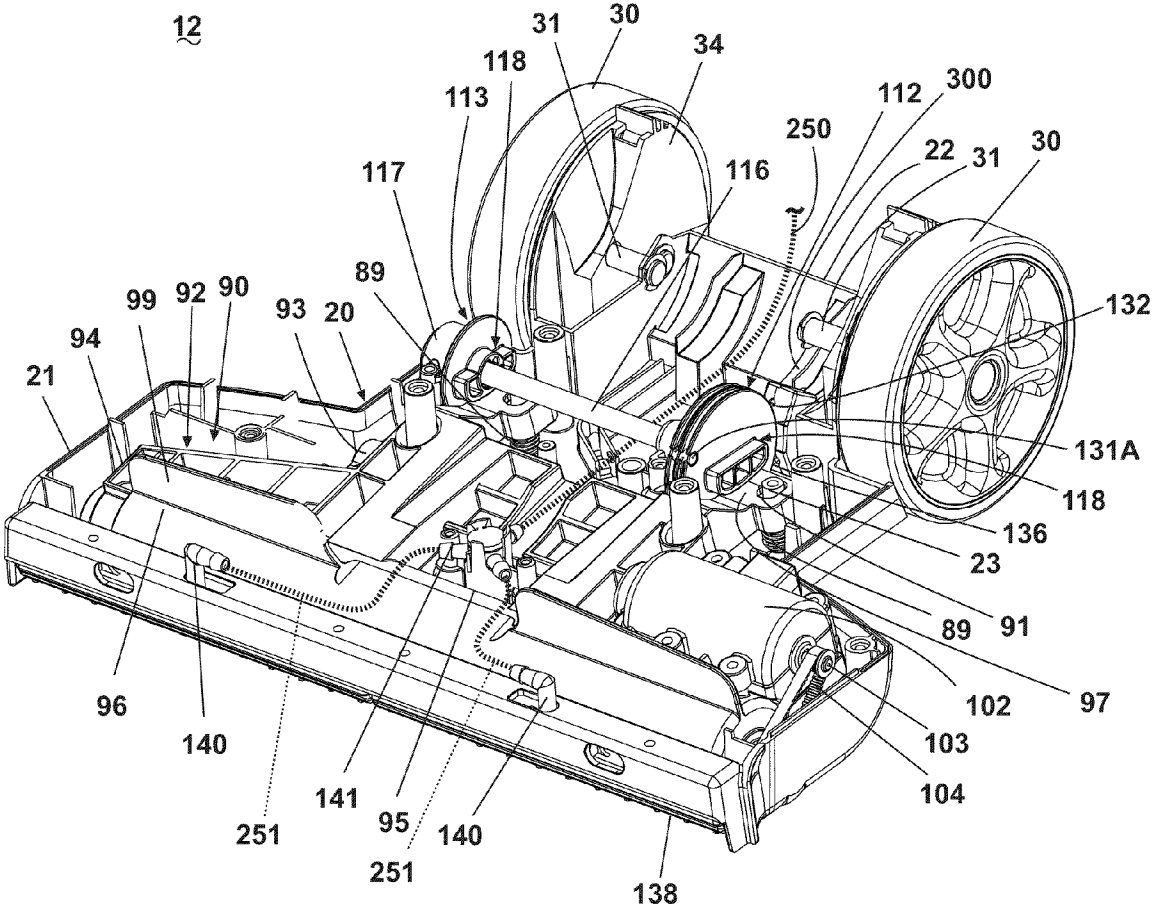
FIG. 3B is a perspective view of the base assembly in FIG. 3A with a diverter housing and hose also removed.
Figure 3C:
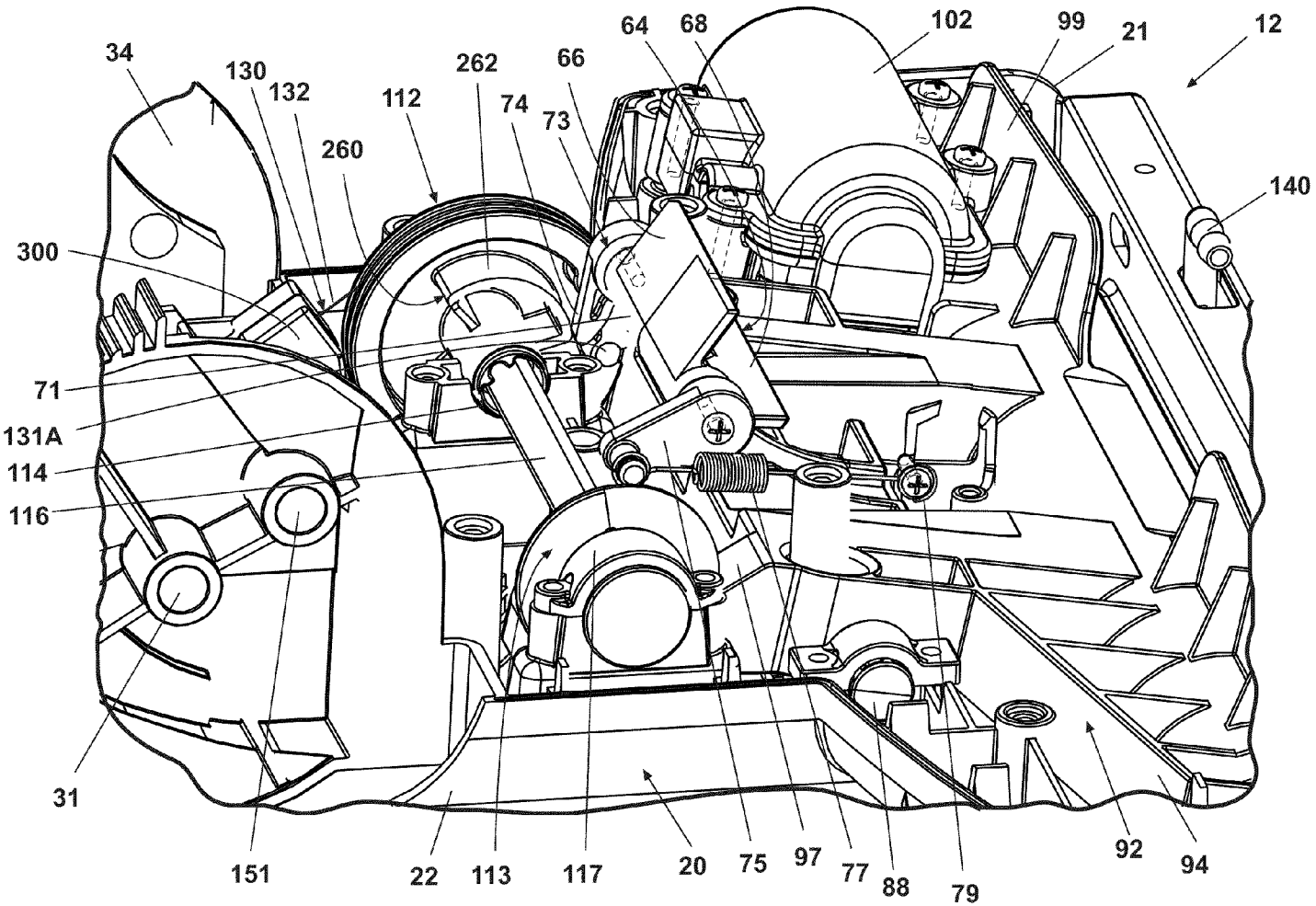
FIG. 3C is a perspective view of the base assembly in FIG. 2A and showing the interaction between a cam assembly and a diverter valve.
Figure 3D:
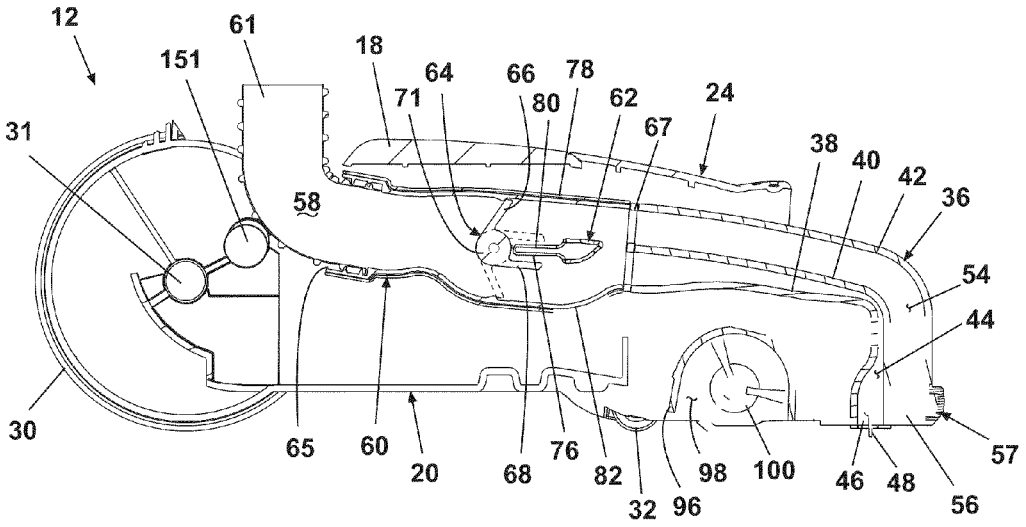
FIG. 3D is a schematic sectional view taken along line 3D-3D of FIG. 2A.

Referring now to FIGS. 2B, 2C, and 3D, the nozzle assembly 36 abuts the diverter housing 60, which comprises an upper wall 78 and a lower wall 82 joined by side walls 81. The diverter housing 60 further comprises a bifurcated first opening 63 in fluid communication with the nozzle assembly 36 and a second opening 65 in fluid communication with a flexible hose 61 that leads to the handle assembly 14. A seal 67 around the first opening 63 seals the connection between nozzle assembly 36 and the diverter housing 60. The upper wall 78 and the lower wall 82 that abut the top wall 42 and the bottom wall 38, respectively, of the nozzle assembly 36. Further, the diverter housing 60 forms a central vane 62 that abuts the middle wall 40 of the nozzle assembly 36 and includes a lower depression 76 and an upper depression 80. The vane 62 separates the wet and dry suction paths 44 and 54 within the diverter housing 60 until they converge into a single suction path 58 near the second opening 65. The single suction path 58 extends from the diverter housing 60 and through the flexible hose 61 to the handle assembly 14.

With additional reference to FIG. 3C, the diverter valve 64 is disposed in the single suction path 58 adjacent the vane 62 to selectively prevent communication between one of the wet and dry suction paths 44 and 54 and the single suction path 58. The diverter valve 64 comprises a first elongated door 66 and a second elongated door 68 that join at a keyed hub 71 situated on a keyed shaft (not shown). The keyed shaft and the diverter valve 64 can rotate to alternate between a wet mode and a dry mode. In addition to the first and second doors 66 and 68, the diverter valve 64 comprises a control lever 73 with first and second levers 72 and 74 mounted on one side of the keyed shaft and external to the diverter housing 60. A biasing arm 75 is mounted to the other side of the keyed shaft and external to the diverter housing 60. A spring 77 connected between the biasing arm 75 and a projection 79 that extends from the side of the diverter housing 60. The biasing arm 75 is coincident with the centerline of the diverter valve, i.e. the biasing arm 75 lies in a plane that bisects the acute angle between the first and second doors 66 and 68. As a result, the spring 77 acts as an over-center biasing member for the diverter valve 64, as will be discussed further hereinafter.

When the diverter valve 64 is in the dry mode, as shown in phantom in FIG. 3D, the first door 66 resides in the upper depression 80 in the central vane 62, and the second door 68 contacts the lower wall 82 of the diverter housing 60 to prevent fluid communication between the single suction path 58 and the wet suction path 44. In this mode, suction from the single suction path 58 is diverted to the dry suction path 54 for pickup from the second nozzle opening 56. Rotation of the keyed shaft and the diverter valve 64 to the dry mode, as shown in FIGS. 3C and 3D, moves the second door 68 so that it rests in the lower depression 76 in the central vane 62, and the first door 66 contacts the upper wall 78 of the diverter housing 60 to prevent communication between the single suction path 58 and the dry suction path 54. In this mode, suction from the single suction path 58 is diverted to the wet suction path 44 for pickup from the first nozzle opening 46. Rotation of the keyed shaft is controlled by the control lever 73, as will be discussed in detail hereinafter. As the control lever 73 approaches a position halfway between the wet and dry modes, the over-center spring 77 biases the biasing arm 75 and, thus, the diverter valve 64 to either the wet or dry mode, depending on the rotation direction. The spring 77, combined with suction forces, holds the diverter valve 64 in place in the wet or dry mode.

In addition to the nozzle assembly 36, the base assembly 12 supports an agitator assembly 90, best seen in FIGS. 2C and 3A-3C. The agitator assembly 90 comprises an agitator platform 92 that is pivotally mounted to the housing 12. The agitator platform 92 is situated on a rod 88 (FIG. 3C) beneath the diverter housing 60 and comprises a rearward portion 93 and an elongated forward portion 94. The forward portion 94 includes a central aperture 95 and a generally semi-cylindrical, downwardly facing agitator cover 96 that forms an agitator chamber 98. A pair of vertical stops 99 extends upwardly along a portion the agitator cover 96. The platform 92 carries an agitator 100, preferably a rotatable horizontal axis brush, in the agitator chamber 98. A motor 102 positioned on the platform 92 adjacent the agitator cover 96 drives the agitator 100. The motor 102 and the agitator 100 are coupled by means of a conventional belt 104 disposed between a motor drive shaft 103 and an agitator pulley 101.

The rearward portion 93 of the agitator platform 92 terminates at two spaced arms 97 with axial openings 91 that each receives an upstanding boss 23 on the base platform 20. A spring 89 disposed around each boss 23 biases the rearward portion 93 of the agitator platform 92 away from the base platform 20 to effectively pivot the agitator platform 92 about the rod 88. As a result, the forward portion 94 is displaced towards the surface to be cleaned to place the agitator 100 in a down position, wherein the agitator 100 contacts the surface to be cleaned. The agitator 100 can be moved to an up position, wherein the agitator 100 is spaced from the surface to be cleaned, by application of downward force on the arms 97 and against the bias of the springs 89 to push the arms 97 towards the base platform 20. In this case, the agitator platform 92 effectively pivots about the rod 88 to displace the forward portion 94 and, thus, the agitator 100 away from the surface to be cleaned. The vertical stops 99 limit the movement of the agitator platform 92. To prevent excessive upward displacement of the agitator platform 92, the vertical stops 99 abut the bottom wall 38 of the nozzle assembly 36. Movement of the agitator 100 between the down and up positions will be discussed further hereinafter.

Figure 4:
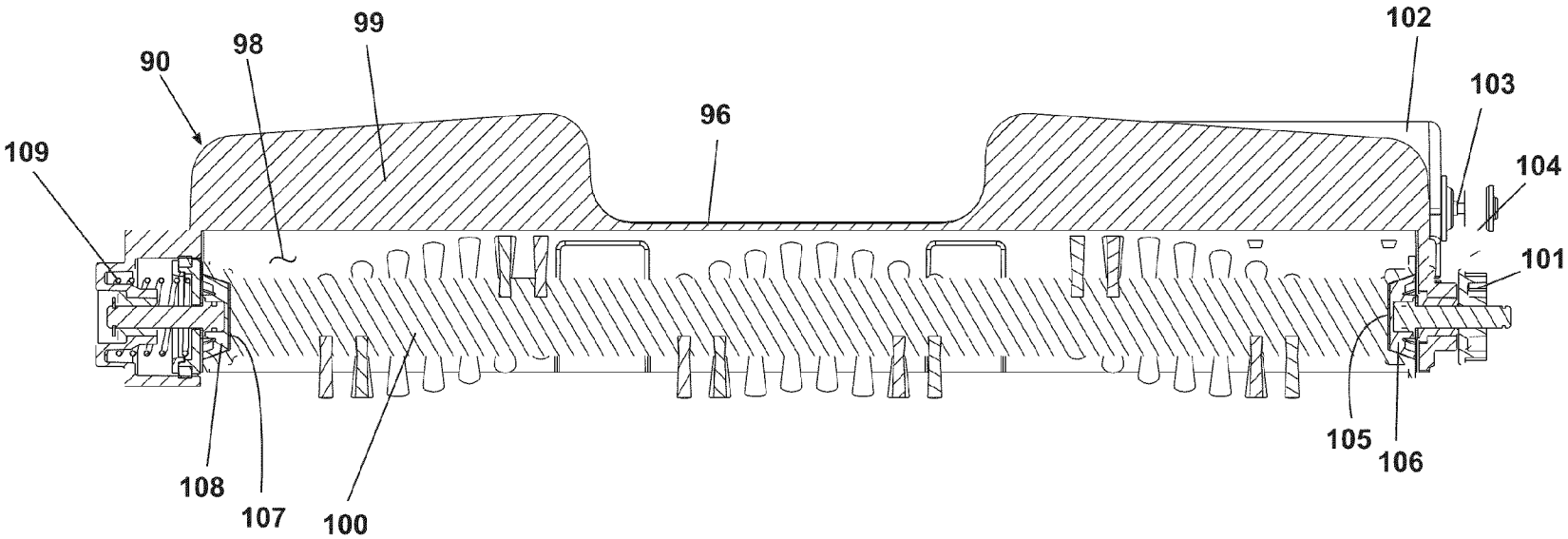
FIG. 4 is a sectional view of the base assembly taken along line 4-4 of FIG. 2C.

Referring now to FIG. 4, the agitator 100 can be removed from the agitator chamber 98 for replacement, repair, cleaning, or other purposes. A first keyed seat 105 within the agitator 100 selectively interlocks a drive gear 106 coupled to the pulley 101 rotatably mounted to the agitator cover 96. The other end of the agitator 100 includes a second keyed seat 107 that selectively interlocks a gear 108 that is slidably and rotatably mounted to the agitator cover 96. A spring 109 disposed between the gear 108 and the agitator cover 96 biases the gear 108 into the second keyed seat 107 and the first keyed seat 105 into the drive gear 106 to thereby retain the agitator 100 in the agitator chamber 98.

Axial force applied to the agitator 100 and against the bias of the spring 109 displaces the agitator 100 in the direction of the spring 109 to thereby compress the spring 109 and laterally displace the gear 108. Consequently, on the other end of the agitator 100, the first keyed seat 105 disengages the drive gear 106 such that the agitator 100 can pivot about the gear 108 for removal from the agitator chamber 98. To mount the agitator 100 within the agitator chamber 98, the above process is conducted in reverse order. Consequently, the agitator 100 can be removed and replaced or interchanged with a different type of agitator 100 if desired.

Referring to FIGS. 2C, 3A-3C, 5A-5C, the cam assembly 110 simultaneously controls movement of the agitator 100 between the up and down positions and rotation of the diverter valve 64 between the wet and dry modes. The cam assembly 110 comprises a generally circular primary cam 112 and a secondary cam 113, each having a keyed center aperture 114 that receives a keyed shaft 116. The cams 112 and 113 are mounted to the base platform 20 with semicircular clamps 117 and can rotate relative to the base platform 20 and the clamps 117. The primary cam 112 comprises spaced circumferential grooves 120 that receive a pull-pull cable 130 and peripheral apertures 122 that house cable stops 131A for mounting the ends of the cable 130 to the primary cam 112.

Figure 5A:
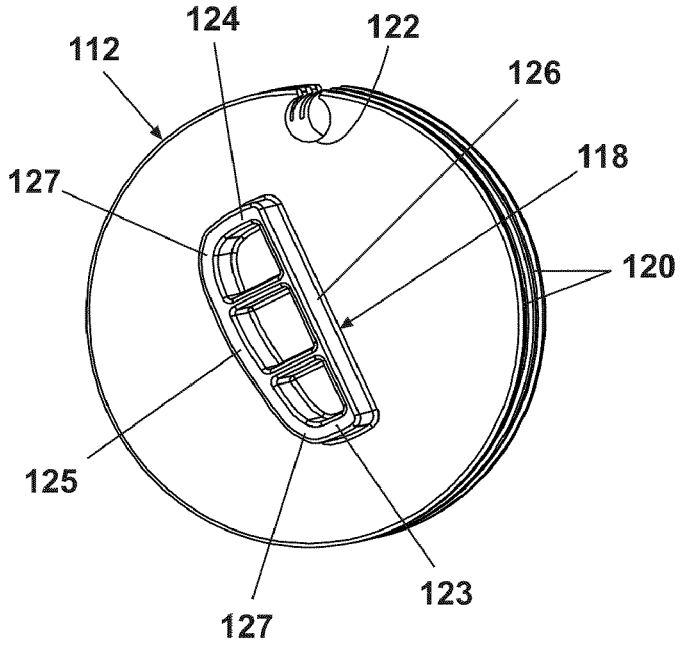
FIG. 5A is a perspective view of a primary cam of the cam assembly in FIG. 3C and showing an agitator cam member on one side of the primary cam.

Both of the cams 112 and 113 comprise an oblong agitator cam member 118 in operable communication with the agitator assembly 90. In particular, the agitator cam members 118 abut the arms 97 of the rearward portion 93 of the agitator platform 92, as best viewed in FIG. 3B. As illustrated in FIG. 5A, the agitator cam member 118 includes spaced first and second short edges 123 and 124 and spaced first and second long edges 125 and 126 that are substantially perpendicular to the short edges 123 and 124. The first and second short edges 123 and 124 are joined to the first long edge 125 by rounded corners 127.

Figure 6A:
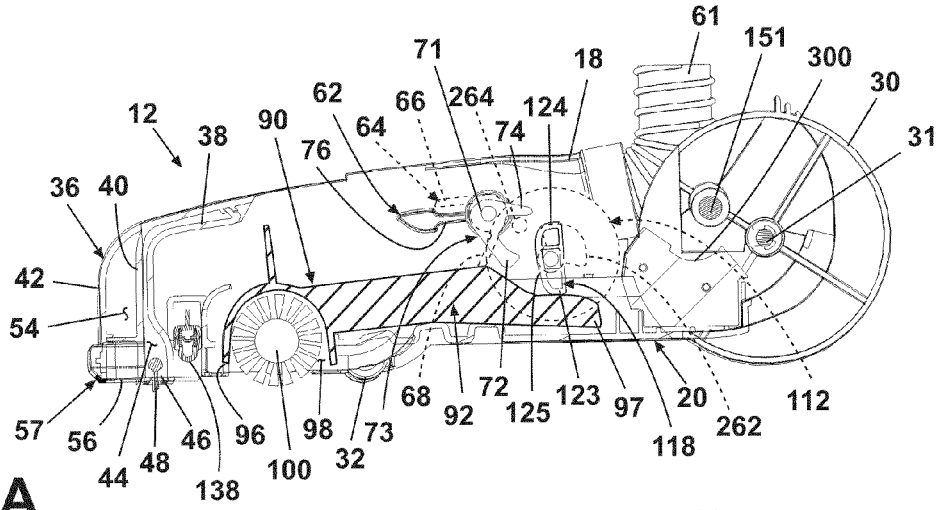
FIGS. 6A-6C are schematic sectional views of the base assembly in FIG. 2A and showing three positions of the primary cam.
Figure 6B:
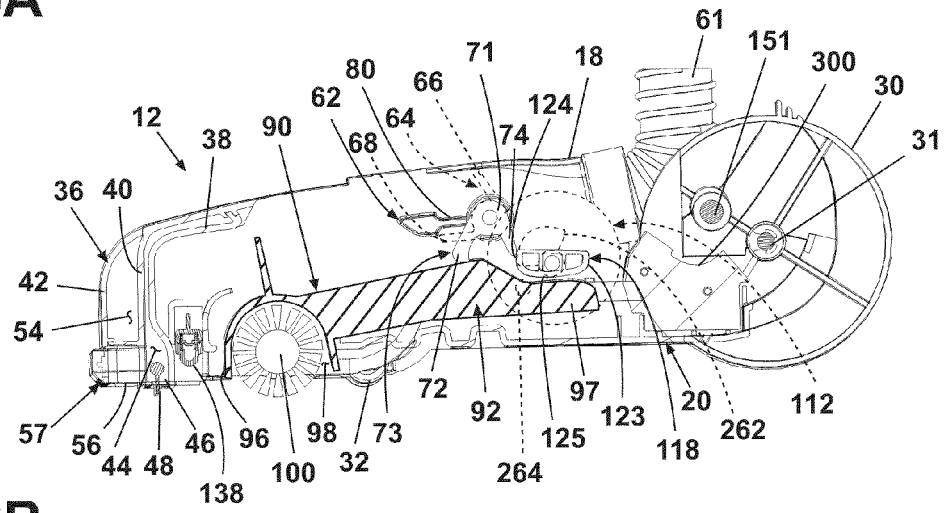
Figure 6C:
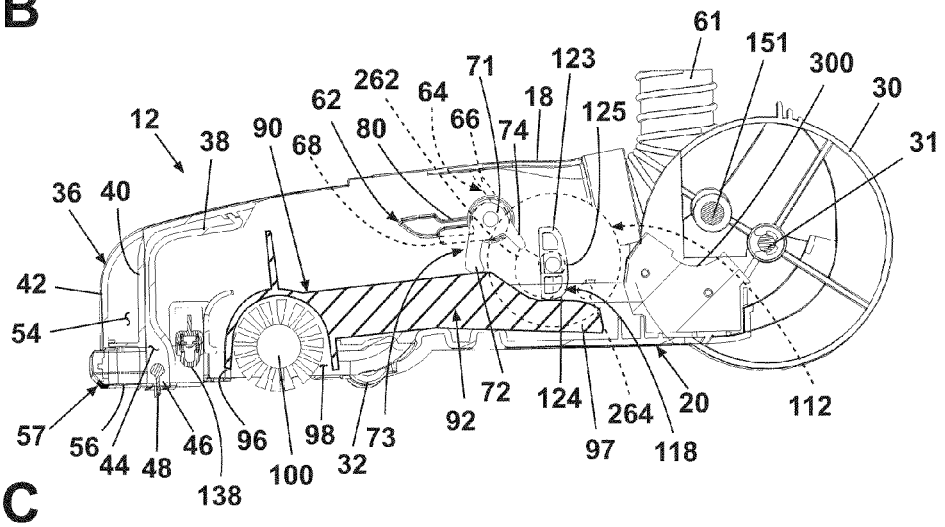

When the first long edge 125 is substantially parallel to the arms 97 of the agitator platform 92, as shown in FIGS. 3A, 3B, and 6B, the springs 89 surrounding the bosses 23 force the arms 97 upward to contact the first long edges 125 and thereby effectively pivot the agitator assembly 90 so that the agitator 100 is in the down position. Conversely, when either of the first and second short edges 123 and 124 is substantially parallel to the arms 97, as viewed in FIGS. 6A and 6C, the agitator cam members 118 apply a downward force to the arms 97 such that the agitator cam members 118 move the agitator platform 92 against the bias of the springs 89. As a result, the agitator platform 92 effectively pivots about the rod 88 to move the agitator 100 to the up position. The rounded corners 127 between the first long edge 125 and the first and second short edges 123 and 124 facilitate smooth transition of the agitator 100 between the down and up positions during rotation of the cams 112 and 113. Because the agitator 100 and agitator motor 102 are both mounted to the agitator platform 92, they are raised and lowered together, which simplifies the belt 104 connection between the two components 100 and 104.

Figure 5B:
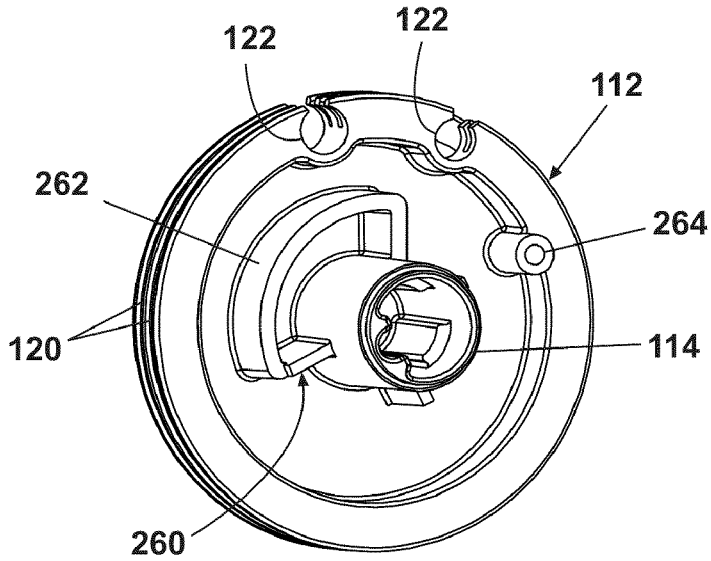
FIG. 5B is a perspective view of the primary cam in FIG. 5A and showing a diverter cam member on the other side of the primary cam.

Referring now to FIGS. 3C and 5B, the cam assembly 110 further comprises a diverter cam member 260 for rotating the diverter valve 64 between the wet and dry modes. The diverter cam member 260 is disposed on the primary cam 112 on the side opposite the agitator cam member 118. The diverter cam member 262 comprises an arcuate lobe 262 that extends through an angle slightly greater than 90-degrees and a boss 264 that operatively communicates with the control lever 73 of the diverter valve 64. As the primary cam 112 rotates, the boss 264 interacts with the control lever 73 to rotate the diverter valve 64 between the wet and dry modes. In particular, the rotating boss 264 pushes against either the first or second levers 72 or 74 (depending on the rotation direction) to rotate the control lever 73 and move the diverter valve 64 to the wet or dry mode, respectively. As stated above, the over-center spring 77 biases the diverter valve 64 to either the wet or dry mode, depending on the rotation direction, as the control lever 73 approaches a position halfway between the wet and dry modes. To move the diverter valve 64 from the dry mode shown in FIG. 6A to the wet mode shown in FIG. 6B, the primary cam 112 rotates such that the boss 264 rotates counterclockwise, relative to the orientation of FIGS. 6A and 6B, to force the first lever 72 to rotate clockwise, relative to the orientation of FIGS. 6A and 6B. As a result, the diverter valve 64 moves to the wet mode with the first door 66 blocking airflow through the dry suction path 54. Conversely, to move the diverter valve from the wet mode shown in FIG. 6B to the dry mode shown in FIG. 6A, the primary cam 112 rotates such that the boss 264 rotates clockwise to force the second lever 74 to rotate counterclockwise. As a result, the diverter valve 64 rotates to a position where the second door 68 blocks airflow through the wet suction path 54. When the diverter valve 64 is in the wet mode, the second lever 74 abuts the arcuate lobe 262, which prevents inadvertent counterclockwise movement, relative to the orientation shown in FIGS. 6A and 6B, of the control lever 73.

Figure 5C:
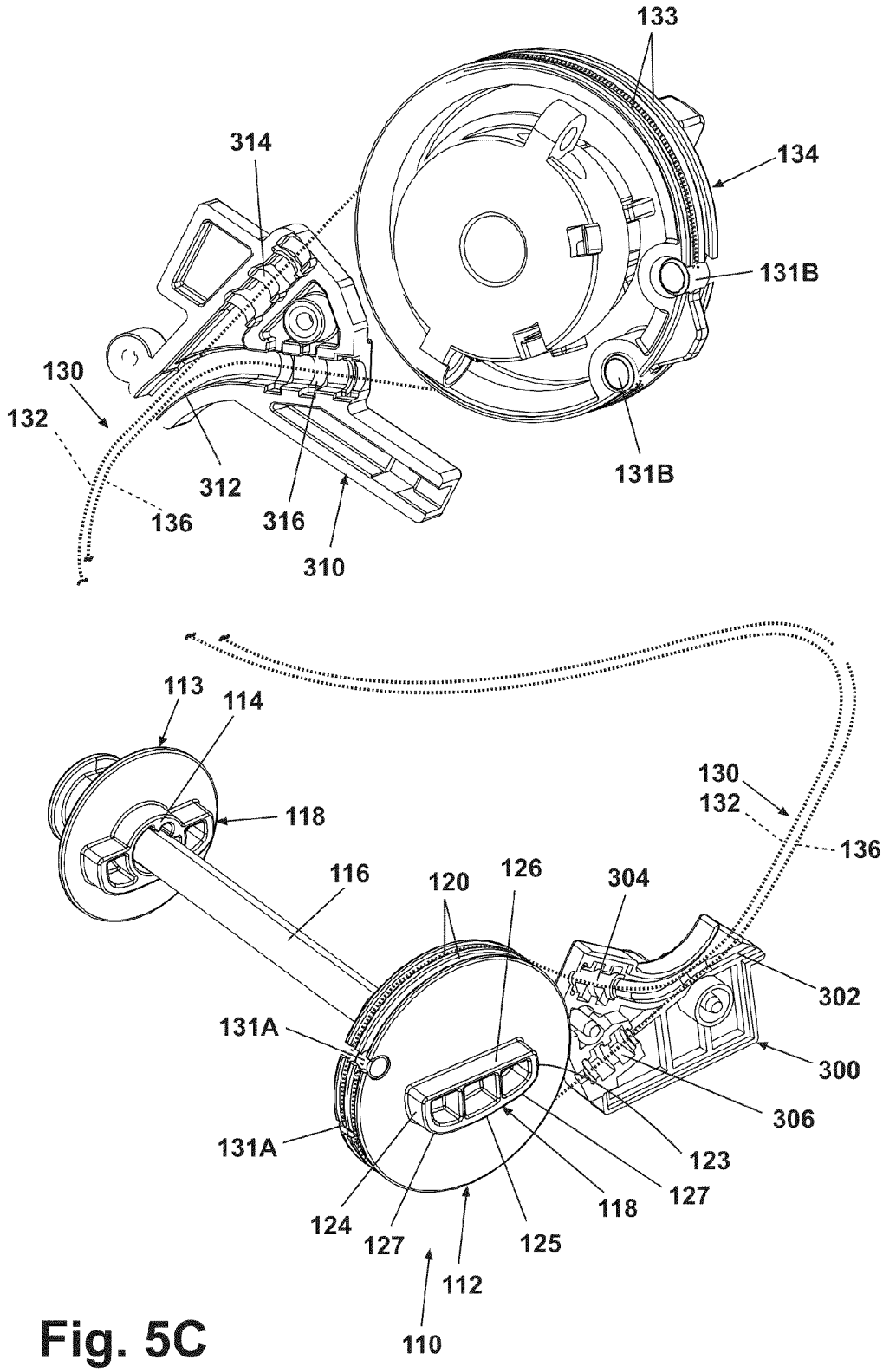
FIG. 5C is a perspective view of the cam assembly of FIG. 3C and an actuator for moving the cam assembly.

Referring particularly to FIG. 5C, rotation of the cams 112 and 113 is accomplished with the pull-pull cable 130. The pull-pull cable 130 comprises a first cable 132 and a second cable 136, both of which extend from an actuator 134 (FIG. 1) in the handle assembly 14 to the primary cam 112. Similar to the primary cam 112, the actuator 134 comprises spaced circumferential grooves 133, wherein each of the grooves 133 receives one of the cables 132, 136. Cable stops 131B secure the ends of the cables 132, 136 to the actuator 134. Adjacent the actuator 134 is a handle cable guide 310, which comprises a pair of secondary channels 314, 316, that merge into a primary channel 312. The first cable 132 extends from its cable stop 131B, rides in one of the grooves 133 of the actuator 134, and enters the handle cable guide 310 at the secondary channel 314. The second cable 136 extends from its cable stop 131B, rides in the other circumferential groove 133 in a direction opposite of the first cable 132, and enters the handle cable guide 310 at the other secondary channel 316. When the secondary channels 314, 316 merge, the first and second cables 132, 136 both reside in the primary channel 312 until they leave the handle cable guide 310.

The first and second cables 300 extend from the handle cable guide 310 to the base assembly, where they enter a base cable guide 300 located adjacent the cam assembly 110. The base cable guide 300 comprises a primary channel 302 that diverges into secondary channels 304, 306. Both the first and second cables 132, 136 enter the base cable guide 300 at the primary channel 302 and then split to reside in their respective secondary channels 304, 306. The first cable 132 leaves the base cable guide 300 through the secondary channel 304 and extends towards the primary cam 112. The first cable 132 rides in one of the grooves 120 along the top of the primary cam 112 and terminates at its cable stop 131A. The second cable 136 leaves the base cable guide 300 through the other secondary channel 306 and extends towards the primary cam 112. The second cable 136 enters the other groove 120 of the primary cam 112 from the bottom of the primary cam 112 and terminates at its cable stop 131A.

Because the actuator 134 is coupled with the cam assembly 110 by the cable 130 in the manner described above, rotation of the actuator 134 in one direction rotates the primary cam 112 in a first direction, and rotation of the actuator 134 in an opposite direction rotates the primary cam 112 in a second direction opposite to the first direction. For example, when the actuator 134 rotates clockwise (relative to the orientation of FIG. 5C), the actuator 134 pulls the first cable 132, which thereby rotates the cam 112 clockwise (relative to the orientation of FIG. 5C). Conversely, when the actuator 134 rotates counterclockwise, the actuator 134 pulls the second cable 136, which thereby rotates the cam 112 counterclockwise. Because the cams 112 and 113 are joined by the keyed shaft 116, the secondary cam 113 rotates with the primary cam 112.

Rotation of the primary cam 112 by means of the pull-pull cable 130 simultaneously controls the positions of the agitator 100 and the diverter valve 64. The single actuator 134 rotates the primary cam 112 and, thus, the secondary cam 113 between at least three positions: a first position (FIG. 6A) wherein the agitator 100 is in the up position and the diverter valve 64 is in the dry mode, a second position (FIG. 6B) wherein the agitator 100 is in the down position and the diverter valve 64 is in the wet mode, and a third position (FIG. 6C) wherein the agitator 100 is in the up position and the diverter valve 64 is in the wet mode. The three positions of the actuator 134 and the primary cam 112 correspond to the following three cleaning modes: dry pickup, wet scrubbing, and wet pickup. In the first position, the first short edge 123 of the agitator cam member 118 abuts the agitator platform 92, and the boss 264 of the diverter cam member 260 is positioned between the first and second levers 72 and 74. When the primary cam 112 moves to the second position from the first position, the first long edge 125 of the agitator cam member 118 abuts the agitator platform 92, and the boss 264 abuts the first lever 72 of the control lever 73 to force the diverter valve 64 to rotate to the wet mode. The diverter valve 64 remains in the wet mode when the primary cam 112 rotates to the third position, and the agitator cam member 118 rotates such that the second short edge 125 abuts the agitator platform 92 to move the agitator 100 to the up position. When the primary cam 112 rotates from the second position to the first position, the agitator cam member 118 rotates such that the first long edge 125 abuts the agitator platform 92, and the boss 264 abuts the second lever 74 of the control lever 73 to force the diverter valve 64 to rotate to the dry mode. Because the primary cam 112 can rotate in two directions, it can rotate between the positions in any reasonable order. For example, the primary cam can rotate from the first to the second to the third positions or from the third to the second to the first positions. Further, the primary cam 112 in the second position can rotate to either the first position or to the third position.

As stated previously, the base assembly 12 supports the cleaning solution dispenser 138, which is best seen in FIGS. 2C, 3A, and 3B, that is part of a cleaning solution dispensing system. The dispenser 138 is preferably disposed between the nozzle assembly 36 and the agitator assembly 90 and, in particular, between the agitator cover 96 and the nozzle assembly bottom wall 38. The dispenser 138 extends transversely along the width of the base assembly 12, and includes a plurality of downwardly facing apertures of uniform or varying size. The dispenser 138 distributes and delivers cleaning solution to the surface to be cleaned through the apertures. The dispenser 138 further includes upstanding L-shaped solution tubes 140 that receive cleaning solution from a distributor 141 mounted to the base platform 20. The distributor 141 is surrounded by the agitator platform 92 and is received with the central aperture 95 of the agitator platform 92 so that the distributor 141 does not interfere with vertical movement of the agitator assembly 90. The distributor 141 and the solution tubes 140 are fluidly connected by a pair of solution conduits 251. The remainder of the cleaning solution dispensing system will be described in detail hereinafter.

Figure 7A:
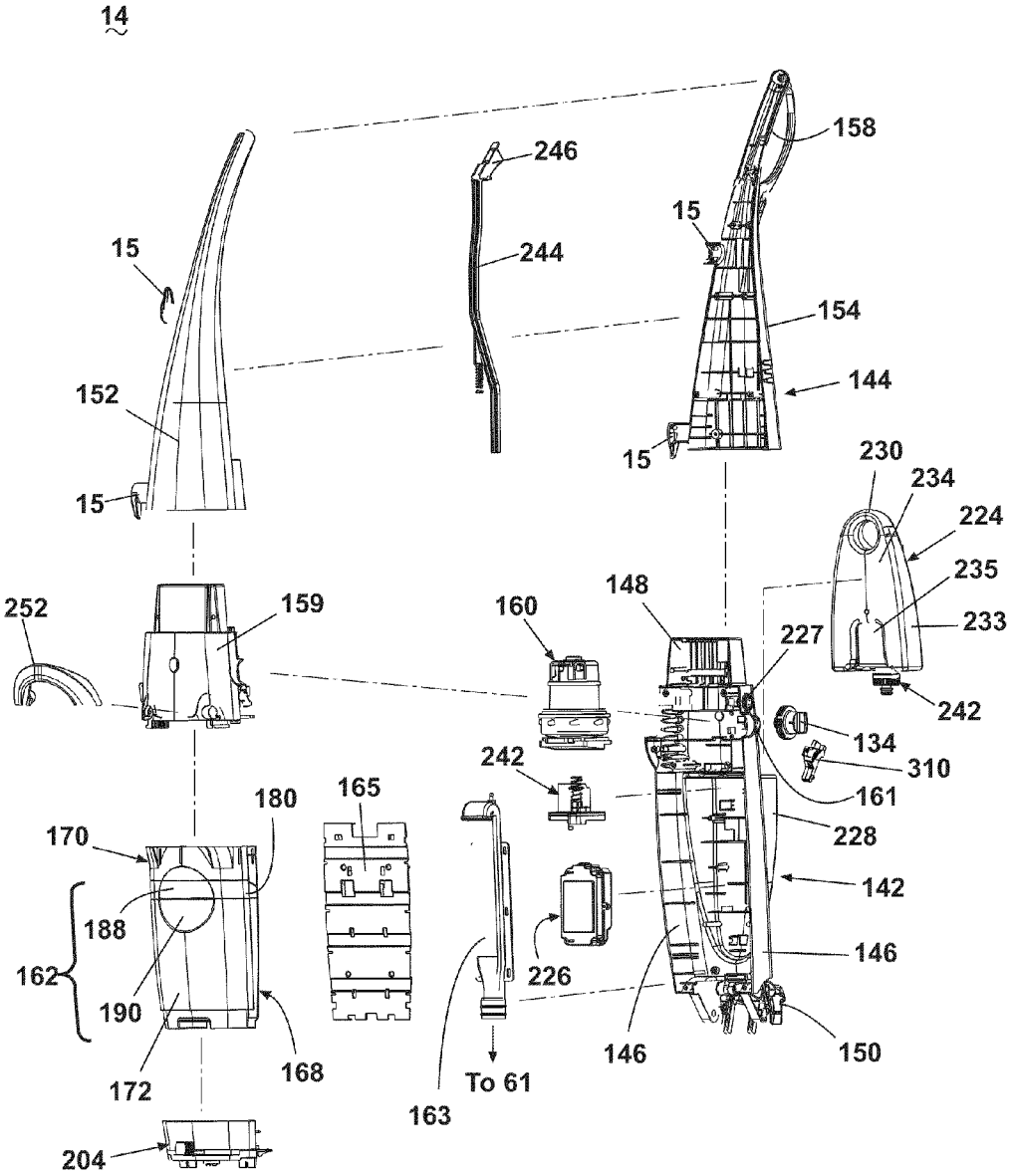
FIG. 7A is an exploded view of the handle assembly in FIG. 1.
Figure 7B:
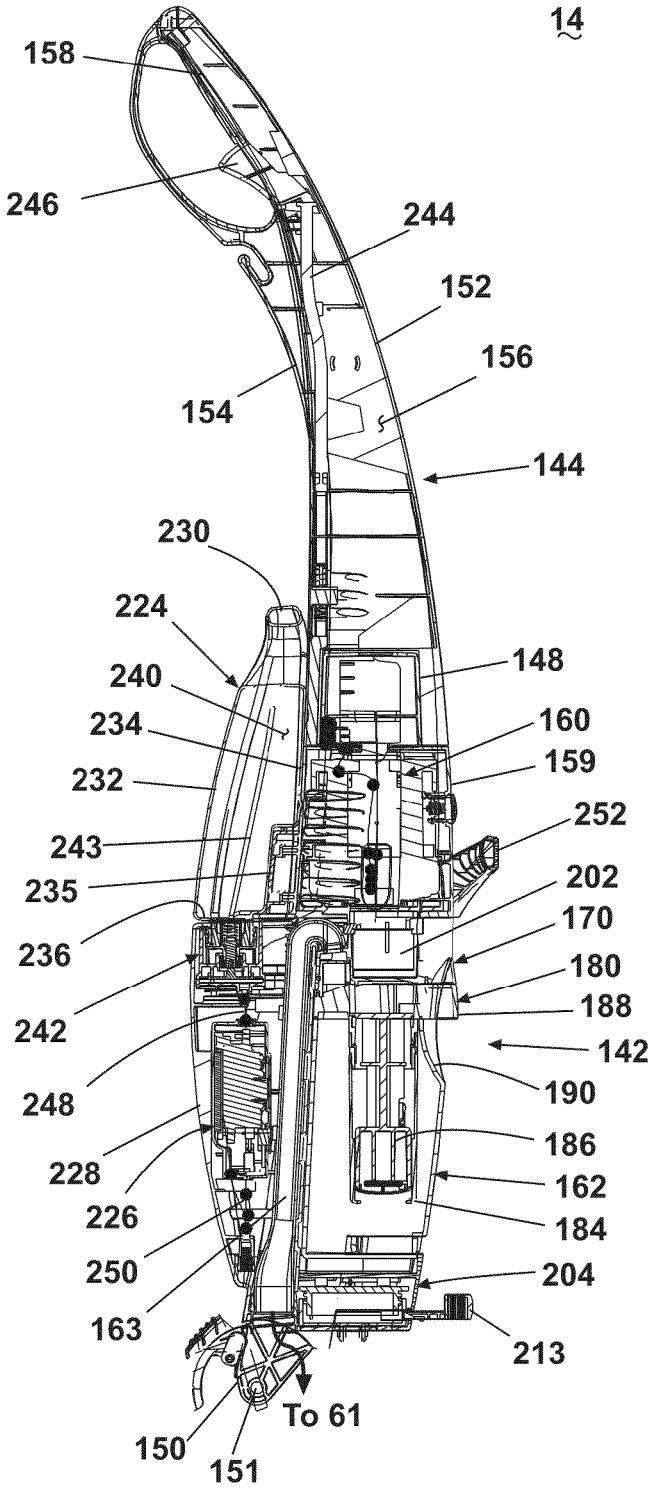
FIG. 7B is a sectional view of the handle assembly in FIG. 1.

Referring now to FIGS. 7A and 7B, the handle assembly 14 comprises a lower handle 142 and an upper handle 144. The lower handle 142 comprises a pair of generally vertical spaced legs 146 joined at the upper ends thereof by a horizontal region 148 and at the rear edges by a rear handle housing 228. Trunnion assemblies 150 with pivot pins 151 are disposed at the lower ends of each spaced leg 146 and mate with the pivot members 34 of the base assembly 12 to form a pivot connection in a conventional fashion. The upper handle 144 comprises a forward section 152 and a rearward section 154 that mate to form a chamber 156 therebetween. The assembled upper handle 144 has a slightly curved profile and terminates at the handle grip 158 at the upper end thereof. The upper handle 144 is mounted to the lower handle 142 at the lower end thereof.

The handle assembly 14 supports several components of a recovery system for removing and storing dry and wet dirt and debris and soiled cleaning solution from the surface to be cleaned. The recovery system comprises a motor and fan assembly 160, the recovery tank assembly 162, and a suction conduit 163. The motor and fan assembly 160, which creates suction forces to remove wet and dry debris from the surface to be cleaned, is disposed within a motor and fan assembly housing 159 mounted to the lower handle 142 adjacent the horizontal region 148. The motor and fan assembly housing 159 comprises an inlet (not shown) and an exhaust outlet (not shown) for the motor and fan assembly 160 at a lower end at an upper end thereof, respectively. The motor and fan assembly 160 draws air through the inlet and exhausts the air through the outlet. Power to the motor and fan assembly 160 is controlled by a user-operated switch 161 preferably located near the cam assembly actuator 134 on the handle assembly 14. Optionally, power to the agitator motor 102 can be controlled with the same switch 161.

Figure 8:
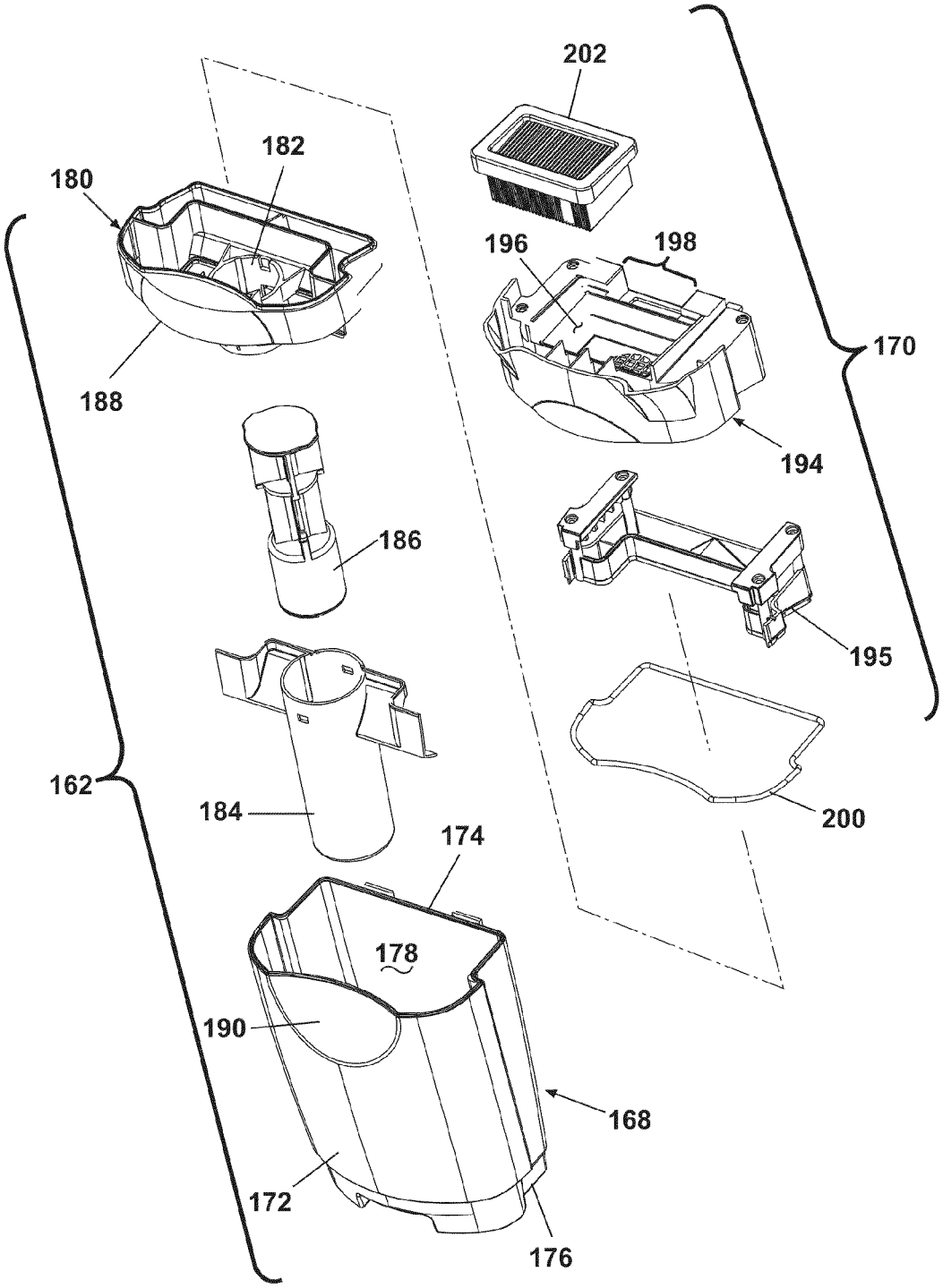
FIG. 8 is an exploded view of a recovery tank assembly and a filter assembly from the handle assembly in FIG. 7A.

With additional reference to FIG. 8, the recovery tank assembly 162 comprises a recovery tank 168 having a generally curved front wall 172, a generally flat rear wall 174 joined to rear edges of the front wall 172, and a bottom wall 176 joined to bottom edges of the front wall 172 and the rear wall 174. A recovery chamber 178 defined within the recovery tank 168 receives and stores dry and wet dirt and debris and soiled cleaning solution. A lid 180 with a cylindrical center aperture 182 is positioned above the recovery tank 168 to enclose the recovery chamber 178. A float cage 184 for holding a float 186 is mounted to the lid 180 in axial alignment with the cylindrical center aperture 182. When the level of liquid in the recovery chamber 178 rises to the level of the float cage 184, the float 186 is forced upward and seals the cylindrical center aperture 182 such that air cannot be drawn from the motor and fan assembly 160 through the recovery chamber 178. The lid 180 further comprises a handle 188 that extends slightly forward of front wall 172 of the recovery tank 168. The lid 180 and the recovery tank front wall 172 each have a depressed region 190 that mate to form a cavity behind the handle 188 to accommodate at least a portion of a user's hand.

A filter assembly 170 is positioned between the recovery tank lid 180 and the motor and fan assembly 160 and comprises an upper housing 194 and a lower housing 195. The upper housing 194 has center and rear channels 196 and 198, which are best viewed in FIG. 8. The housing 194 is joined to the lid 180 with a seal 200 therebetween, and the center channel 196 is aligned with the cylindrical center aperture 182 of the lid 180 and the inlet to the motor and fan assembly 160. A filter 202, preferably a replaceable filter, is located in the center channel 196 to remove particles that are drawn with the working air through the cylindrical center aperture 182 to thereby prevent the remaining particles from entering into the motor and fan assembly 160.

Figure 10A:
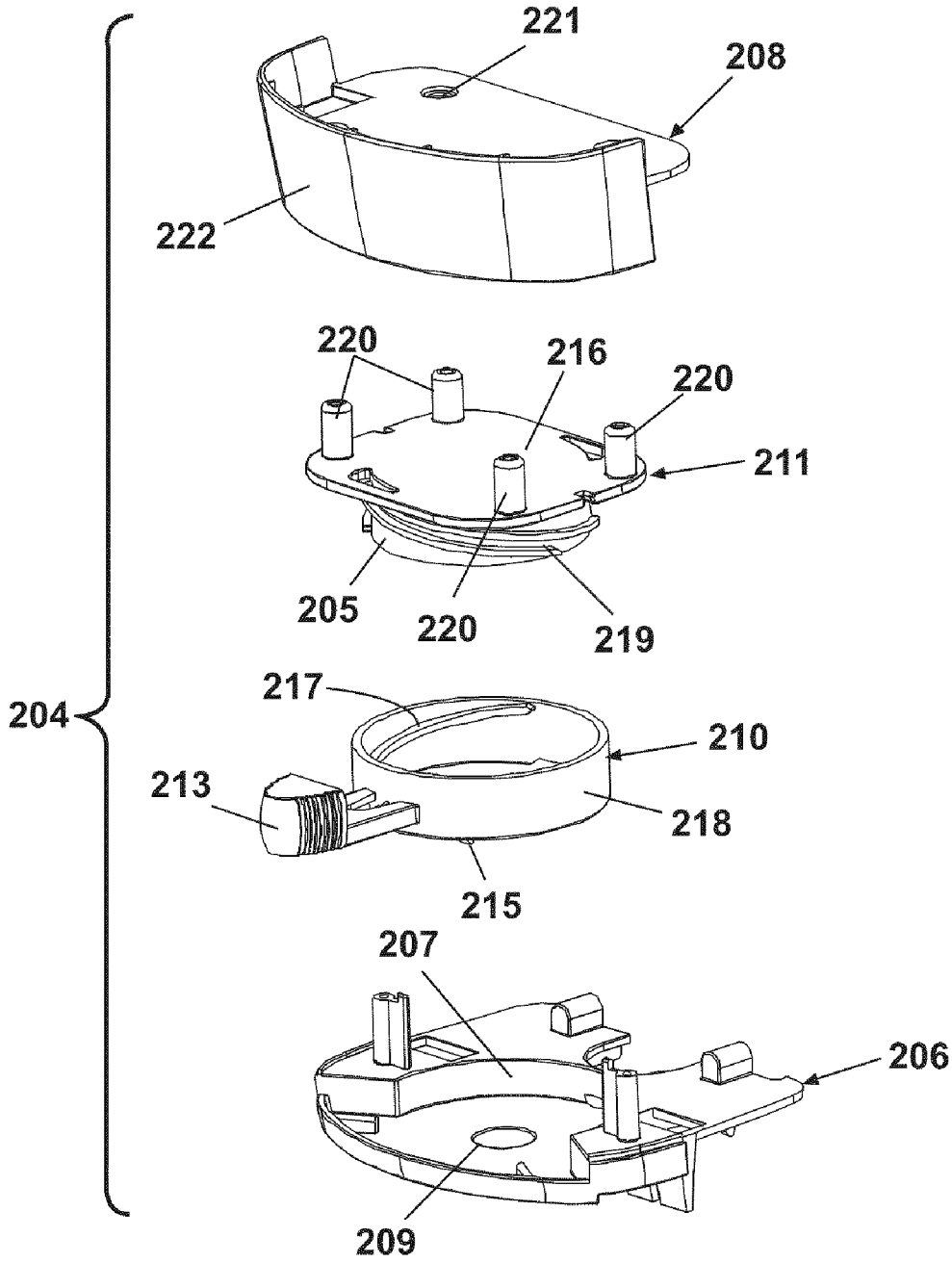
FIG. 10A is an exploded view of a recovery tank latch assembly from the handle assembly in FIG. 7A.
Figure 10B:
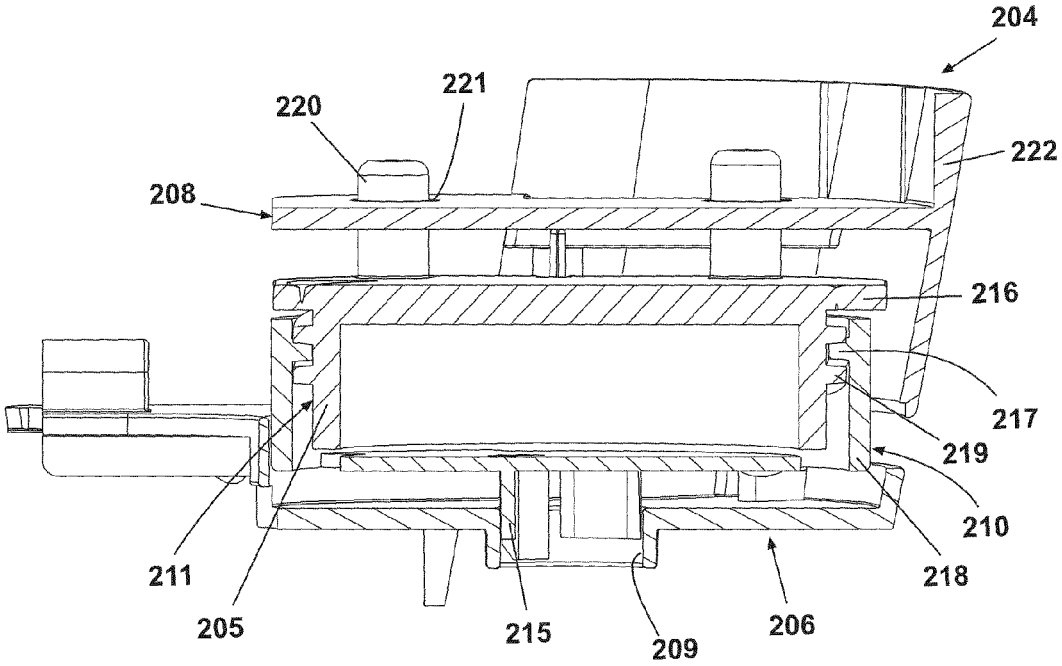
FIGS. 10B and 10C are sectional views of the recovery tank assembly and the recovery tank latch assembly from FIG. 10A and showing the recovery tank latch assembly in a down position (FIG. 10B) and an up position (FIG. 10C).
Figure 10C:
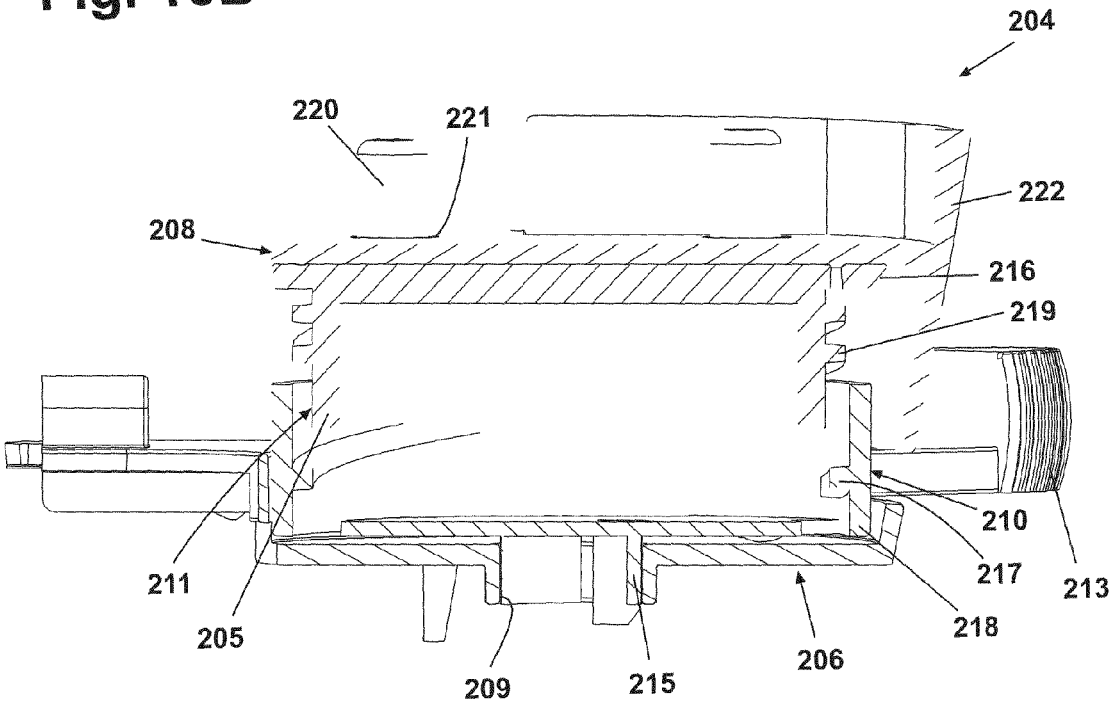

The recovery tank assembly 162 is situated on a recovery tank latch assembly 204, shown in detail in FIGS. 10A-10C, which is mounted to the lower handle 142 and comprises a lower platform 206 and an upper platform 208 with a rotatable cam latch 210 and a cam follower 211 therebetween. The lower platform 206 comprises a circular depression 207 that receives the cam latch 210. The cam latch 210 is a generally tubular structure 218 with a radially extending latch handle 213 that projects forward of the handle assembly 14 and an axial stub 215 that is rotatably received in a central opening 209 in the lower platform 206. The cam latch 210 further comprises circumferential ramps 217 on the inner surfaces of the tubular structure 218. The cam follower 211 comprises a cylindrical lower portion 205 sized to be axially received within the tubular structure 218 and a planar upper portion 216. The lower portion 205 includes a series of external threads 219 in operative communication with the cam latch ramps 217. Further, the upper portion 216 comprises a plurality of upstanding pins 220 on its upper surface that are aligned with a plurality of holes 221 through the upper platform 208. The upper platform 208 further comprises an integral shield 222 that hides a portion of the recovery tank latch assembly 204 for aesthetic purposes.

While lower platform 206 and the upper platform 208 are stationary with respect to the handle assembly 14, the cam latch 210 can be rotated by moving the latch handle 213 in an arcuate path. When the cam latch 210 rotates, the cam follower threads 219 ride along the cam latch ramps 217, as in a conventional mechanical thread. Consequently, rotation of the cam latch 210 vertically displaces the cam follower 211 within the tubular structure 218 to thereby move the pins 220 between a down position, wherein the planar upper portion 216 is spaced from the upper platform 208 and the pins 220 project above the upper platform 208 a first distance, as shown in FIG. 10B, and an up position, wherein the planar upper portion 216 abuts the upper platform 208 and the pins 220 project above the upper platform 208 a second distance greater than the first distance, as illustrated in FIG. 10C.

To mount the recovery tank assembly 162 to the handle assembly 14, a user situates the recovery tank latch assembly 204 so that the pins 220 are in the down position and places the recovery tank assembly 162 on the upper platform 208. Next, the user rotates the latch handle 213 through an arc to thereby rotate the cam latch 210 and raise the cam follower 211. As the cam follower 211 rises, the pins 220 move to the up position, contact the bottom wall 176 of the recovery tank 168, and push the recovery tank assembly 162 upwards to effectively seal the lid 180 with the filter assembly 170.

To remove the recovery tank assembly 162, a user arcuately slides the latch handle in an opposite direction to thereby lower the cam follower 211 and move the pins 220 to the down position. The recovery tank assembly 162 moves downward with the cam follower 211 and is, therefore, no longer sealed with the filter assembly 170. The user can thereafter pull the recovery tank assembly 162 from the handle assembly 14 by grasping the recovery tank 168 and the handle 188 on the recovery tank lid 180. When the recovery tank assembly 162 is removed from the bare floor cleaner 10, the recovery chamber 178 can be emptied, and the filter assembly 170 can be removed from the bare floor cleaner 10 for cleaning and replacement of the filter 202, if necessary.

Referring to FIGS. 7A and 7B, the suction conduit 163 couples with the flexible hose 61 adjacent the base assembly 12 and extends up the handle assembly 14, specifically between the spaced legs 146 of the lower handle 142, and curves forward approximately 180-degrees to terminate in the rear channel 198 of the filter assembly 170 for connection to the recovery tank 168. At this point, the single suction path 58, which extends from within the diverter housing 60, through the flexible hose 61, and through the suction conduit 163, fluidly communicates with the recovery chamber 178 and, therefore, the filter assembly 170 and the motor and fan assembly 160. Recovered soiled liquid and air in the suction conduit 163 turns 180-degrees and impinges on baffle surfaces while entering the recovery chamber 178. As a result, the airflow slows, the liquid and debris separates from the air and drops down into the recovery tank 168 while the recovered air continues to travel through the filter assembly 170 and the motor and fan assembly 160. A panel 165 mounted between the spaced legs 146 hides the suction conduit 163 from view when the recovery tank assembly 162 is removed form the handle assembly 14.

The motor and fan assembly 160 creates an airflow that is drawn through a working air path defined by either the wet or dry suction path 44 or 54 of the nozzle assembly 36, the single suction path 58 through the diverter housing 60, the hose 61, and the suction conduit 163, the recovery chamber 178, the central channel 196 of the filter assembly 170, and the inlet of the motor and fan assembly 160. The recovery system is a clean air system wherein the debris is removed from the working air path prior to reaching the motor and fan assembly 160.

Figure 9:
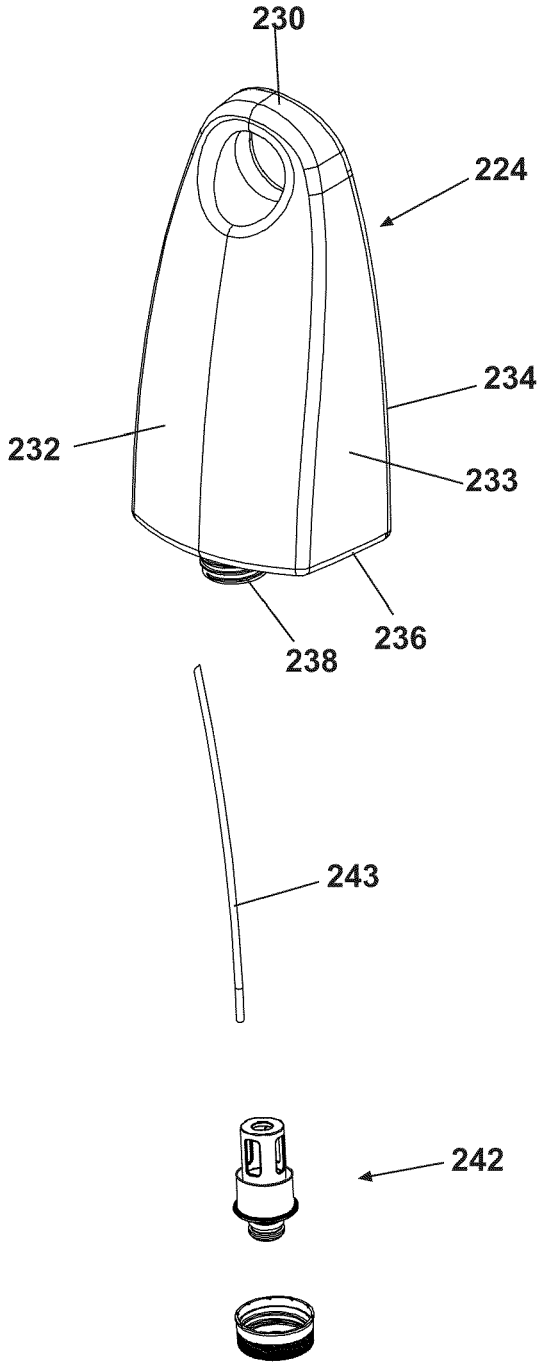
FIG. 9 is an exploded view of a cleaning solution supply tank from the handle assembly in FIG. 7A.

Referring now to FIGS. 7A, 7B, and 9, the handle assembly 12 also supports several components of the cleaning solution dispensing system, which stores and preferably heats cleaning solution and distributes the cleaning solution to the surface to be cleaned. The dispensing system comprises the cleaning solution supply tank 224, a supply tank feed valve 242 operated by a trigger 246 disposed in the handle grip 158, and an in-line heating element 226 that optionally heats the cleaning solution before it reaches the distributor 141 and the dispenser 138 described hereinabove.

The supply tank 224 is seated on the rear handle housing 228 of the lower handle 142. The rear handle housing 228 is preferably located behind the recovery tank assembly 162 such that the supply tank 224, when seated on the rear handle housing 228, is positioned substantially adjacent the motor and fan assembly 160. The supply tank 224 has a generally triangular shape with an integrally formed handle 230 to facilitate removal and transportation of the supply tank 224. The supply tank comprises a curved front wall 232 joined to side walls 233, a substantially flat rear wall 234 with a depression 235 to facilitate mounting the supply tank 224 to the handle assembly 14, and a bottom wall 236 with a tank feed/fill opening 238. The supply tank 224 defines a supply chamber 240 for storing cleaning solution, which is supplied through the tank feed/fill opening 238. The tank feed/fill opening 238 is sized to receive the supply tank feed valve 242, which is coupled to a vent tube 243 that projects into the supply chamber 240. Further details of the supply tank 224 and the supply tank feed valve 242 are disclosed in U.S. Pat. No. 6,467,122, which is incorporated herein by reference in its entirety. The supply tank feed valve 242 is operatively coupled with a rod 244 connected to the trigger 246. The supply tank feed valve 242 is normally biased to a closed position and can be urged to an open position by squeezing the trigger 246 to thereby displace the rod 244 to open the supply tank feed valve 242. When the supply tank feed valve 242 is in the open position, cleaning solution flows from the supply tank 224 and through the valve 242 under the influence of gravity. The supply tank feed valve 242 is fluidly connected to the in-line heating element 226 by a first supply conduit 248.

The in-line heating element 226 is preferably mounted in the rear handle housing 228 and receives the first supply conduit 248 at an upper end and a second supply conduit 250 at a lower end. A suitable in-line heating element 226 is disclosed in U.S. Pat. No. 6,131,237, which is incorporated herein by reference in its entirety. The cleaning solution is delivered by force of gravity or, alternatively, by a fluid pump to the in-line heating element 226 through the first supply conduit 248. The in-line heating element 226 heats the cleaning solution as it travels therethrough, and the cleaning solution exits the in-line heating element 226 through the second supply conduit 250. The second supply conduit 250 can comprise one more individual conduits to deliver heated cleaning solution from the in-line heating element 226 to the distributor 141 in the foot assembly 12. Power to the in-line heating element 226 is controlled by a user-operated switch 227 preferably located near the cam assembly actuator 134 on the handle assembly 14. When heated cleaning solution is desired, the user activates the in-line heating element 226 with the switch 227. Otherwise, the cleaning solution flows through the inactivated in-line heating element 226 without a significant increase in temperature.

As best seen in FIG. 3B, the second supply conduit 250 fluidly communicates the in-line heating element 226 with the distributor 141 and the dispenser 138 in the base assembly 12. The cleaning solution from the in-line heating element 226 travels under force of gravity to the distributor 141, which distributes the cleaning solution to the dispenser 138. After entering the dispenser 138 through the tubes 140, the cleaning solution flows through the apertures to the surface to be cleaned. Optionally, the bare floor cleaner 10 can further comprise a fluid pump in the handle assembly 14 or the base assembly 12 to pump the cleaning solution from the cleaning solution dispensing system.

To operate the bare floor cleaner 10, the cleaning solution tank 224 is removed from the handle assembly 14, and cleaning solution is delivered to the supply chamber 240 through the tank feed/fill opening 238. The filled cleaning solution tank 224 is returned to the bare floor cleaner 10 and seated on the rear handle housing 228. Next, the handle assembly 14 is pivoted to the reclined working position, and electricity is provided to the motor and fan assembly 160 and the agitator motor 102 through the switch 161 on the handle assembly 14. The motor and fan assembly 160 draws a vacuum through the nozzle assembly 36, the diverter housing 60, the flexible hose 61, the suction conduit 163, the recovery tank assembly 162, and the central channel 196 of the filter assembly 170.

The bare floor cleaner can operated in the three previously described cleaning modes: dry pickup, wet scrubbing, and wet pickup. The cleaning mode is selected by rotating the actuator 134 on the handle assembly 14. For exemplary purposes, the operation of the dry pickup mode will be described first, followed by the operation of the wet scrubbing mode and, finally, the wet pickup mode. The modes, however, can be operated in any order. The order in which the modes are described and the exemplary descriptions of each mode are not intended to limit the invention in any manner.

In the dry pickup mode, the pull-pull cable 130, which is operatively connected to the actuator 134, rotates the cams 112 and 113 to the first position to orient the agitator 100 in the up position and the diverter 64 in the dry mode to permit suction through the dry suction path 54 and to prevent suction through the wet suction path 44. As the bare floor cleaner 10 moves over the surface to be cleaned, loose dirt, dust, debris, and the like located near the second nozzle opening 56 are drawn into the dry suction path 54. Particles of a relatively large size, such as the size of a piece of popcorn, can enter the second nozzle opening 56 due to the clearance between the top wall 42 of the nozzle assembly 36 and the surface to be cleaned. Dirt and air in the dry suction path 54 are drawn into the diverter housing 60, past the diverter 64 into the single suction path 58, through the hose 61 and suction conduit 163, and through the 180-degree turn into the recovery chamber 178, where the dirt is separated from the working air and stored therein. The air continues to be drawn through the center cylindrical aperture 182 of the lid 180 and the filter 202 in the center channel 196 of the filter assembly 170, where any remaining dust and the like is removed from the air. Finally, the clean air enters the inlet of the motor and fan assembly 160 and exits through the exhaust outlet. After the loose dirt, dust, debris, and the like are removed from the surface to be cleaned, the actuator 134 is rotated to operate the bare floor cleaner 10 in the wet scrubbing mode.

In the wet scrubbing mode, the pull-pull cable 130 rotates the cams 112 and 113 to the second position such that the agitator 100 is in the down position and the diverter 64 is in the wet mode to permit suction through the wet suction path 44 and to prevent suction through the dry suction path 54. If the user desired heated cleaning solution, the switch 227 on the handle assembly actuated to activate the in-line heating element 226. To apply cleaning solution to the surface to be cleaned, the trigger 246 on the handle grip 158 is depressed and thereby moves the rod 244 to open the cleaning solution feed valve 242. Cleaning solution travels from the supply chamber 240 and through the cleaning solution feed valve 242 and the first supply conduit 248 to the in-line heating element 226, where the cleaning solution is optionally heated. The cleaning solution leaves the in-line heating element 226 and flows under the force of gravity through the second supply conduit 250 to the distributor 141, through the solution conduits 251 to the dispenser 138, and, ultimately, to the surface to be cleaned. As the bare floor cleaner 10 moves forward and backward over the surface to be cleaned, the rotating agitator 100 interacts with the cleaning solution and the dirt, dust, and debris adhered to the surface to be cleaned. Such interaction removes the adhered dirt, dust, and debris, which become suspended in the cleaning solution.

Soiled cleaning solution and dirt near the first nozzle opening 46 is scraped by the squeegee 48 and drawn into the wet suction path 44. When the bare floor cleaner 10 moves forward, the soiled cleaning solution collects between the squeegee 48 and the middle wall 40 of the nozzle assembly 36, whereas the soiled cleaning solution collects between the squeegee 48 and the bottom wall 38 of the nozzle assembly 36 when the bare floor cleaner 10 moves backward. Optionally, the motor and fan assembly 160 can be inoperative during the wet scrubbing mode so that the soiled cleaning solution is not removed from the surface to be cleaned.

When the motor and fan assembly 160 is operative, soiled cleaning solution, dirt, and air in the wet suction path 44 are drawn into the diverter housing 60, past the diverter 64 into the single suction path 58, through the hose 61 and suction conduit 163, and through the 180-degree turn into the recovery chamber 178, where the soiled cleaning solution and dirt are separated from the working air and stored therein. The air is drawn through the center cylindrical aperture 182 of the lid 180 and the filter 202 in the center channel 196 of the filter assembly 170, where any remaining dust and the like is removed from the air. Finally, the clean air enters the inlet to the motor and fan assembly 160 and exits through the exhaust outlet. After the wet scrubbing mode is completed, the actuator 134 is rotated to operate the bare floor cleaner 10 in the wet pickup mode.

In the wet pickup mode, the pull-pull cable 130 rotates the cams 112 and 113 to the third position such that the agitator 100 is in the up position and the diverter 64 is in the wet mode to permit suction through the wet suction path 44 and to prevent suction through the dry suction path 54. As the bare floor cleaner 10 moves forward and backward over the surface to be cleaned, soiled cleaning solution and dirt near the first nozzle opening 46 is scraped by the squeegee 48 and drawn into the wet suction path 44. When the bare floor cleaner 10 moves forward, the soiled cleaning solution collects between the squeegee 48 and the middle wall 40 of the nozzle assembly 36, whereas the soiled cleaning solution collects between the squeegee 48 and the bottom wall 38 of the nozzle assembly 36 when the bare floor cleaner 10 moves backward. As in the wet scrubbing mode, soiled cleaning solution, dirt, and air in the wet suction path are drawn into the diverter housing 60, past the diverter 64 into the single suction path 58, through the hose 61 and the suction conduit 163, and through the 180-degree turn into the recovery chamber 178, where the soiled cleaning solution and dirt are separated from the working air and stored therein. The air is then drawn through the center cylindrical aperture 182 of the lid 180 and the filter 202 in the center channel 196 of the filter assembly 170, where remaining dust and the like is removed from the air. Finally, the clean air enters the inlet to the motor and fan assembly 160 and exits through the exhaust outlet.

After the wet pickup mode is completed, the electricity to the motor and fan assembly 160 and the brush motor 102 is turned off via the switch 161, power to the in-line heating element 226 is turned off via the switch 227 if heated cleaning solution is utilized, and the handle assembly 14 can be pivoted to the upright storage position. Because the bare floor cleaner 10 is efficient at removing soiled solution from the surface, only a short drying time is required before foot traffic is acceptable.

Following use of the bare floor cleaner 10, the recovery tank assembly 162 can be removed as described hereinabove to empty the recovery chamber 178. Removal of the recovery tank assembly 162, or the supply tank 224, can be accomplished while the handle assembly 14 is in either the upright or reclined positions. When the recovery chamber 178 becomes full during use of the bare floor cleaner 10, the float 186 closes the cylindrical center aperture 182 of the recovery tank lid 180, thereby ceasing operation of the recovery system. At this point, the recovery tank assembly 162 should be removed to empty the recovery chamber 178.

In addition to the three operation modes described above, the bare floor cleaner 10 can alternatively be configured to operate in a fourth mode, a dry scrubbing mode, wherein the agitator 100 is in the down position and the diverter 64 in the dry mode to permit suction through the dry suction path 54 and to prevent suction through the wet suction path 44. In this alternative embodiment, the agitator cam members 118 on the primary cam 112 and the secondary cam 113 and the diverter cam member 260 on the primary cam 112 are altered such that the agitator 100 and the diverter 64 can be suitably positioned for the dry scrubbing mode.

An alternative base assembly 12' for the bare floor cleaner 10 is illustrated in FIGS. 11A-14, where like elements are identified with the same reference numeral bearing a prime (') symbol. The primary differences between the alternative base assembly 12' and the first embodiment base assembly 12 are the latch 24' for securing the nozzle assembly 36' to the base assembly 12', the agitator assembly 90', and the cam assembly 110'.

Figure 11A:
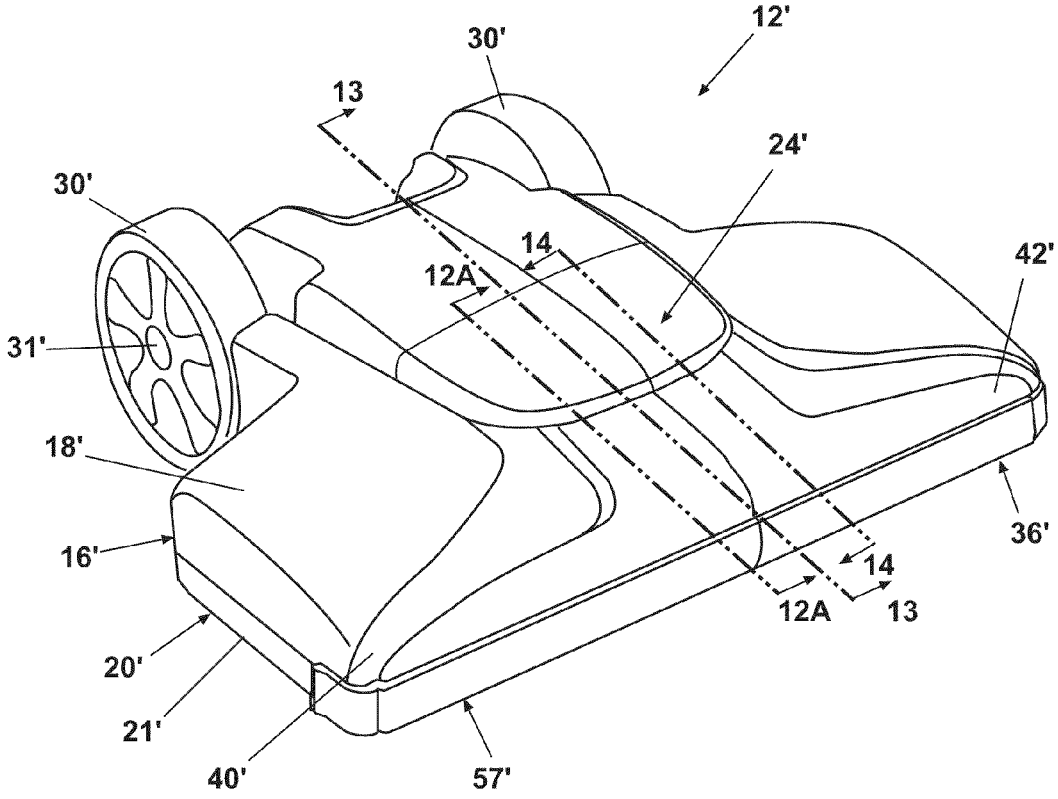
FIG. 11A is perspective view of an alternative base assembly, wherein a latch is in a locked position to lock a nozzle assembly to a housing of the base assembly.
Figure 11B:
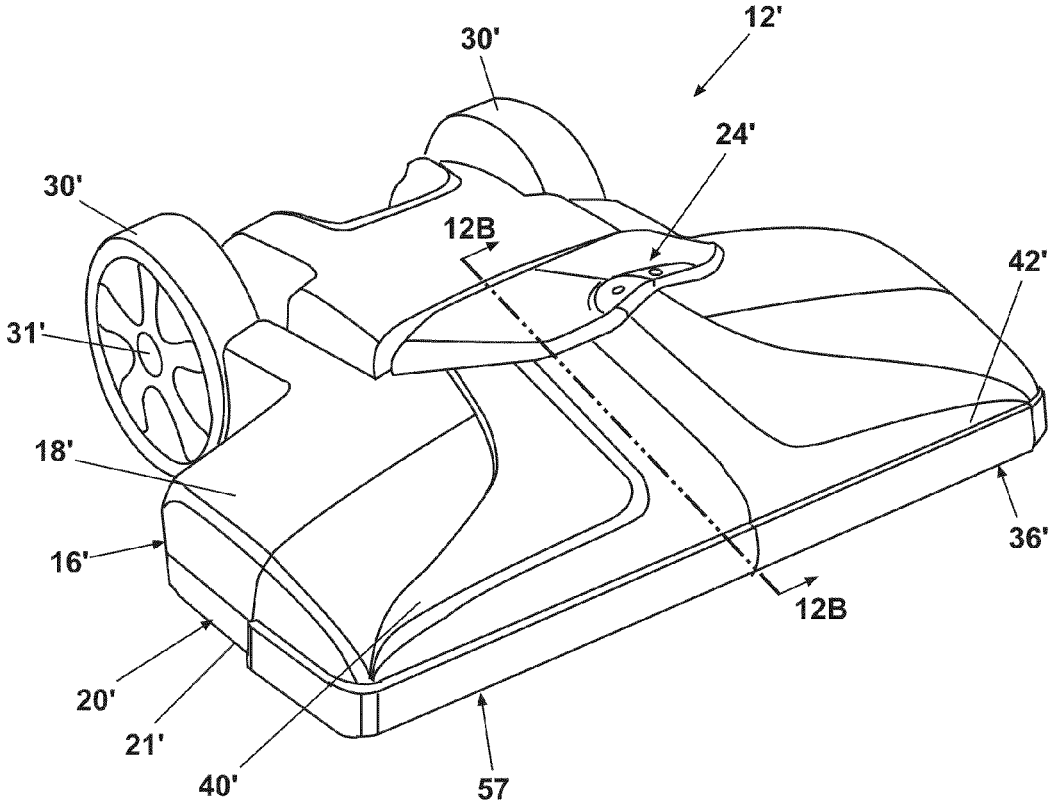
FIG. 11B is a perspective view of the base assembly in FIG. 11A, wherein the latch is in an unlocked position to facilitate removal of the nozzle assembly from the housing.
Figure 12A:
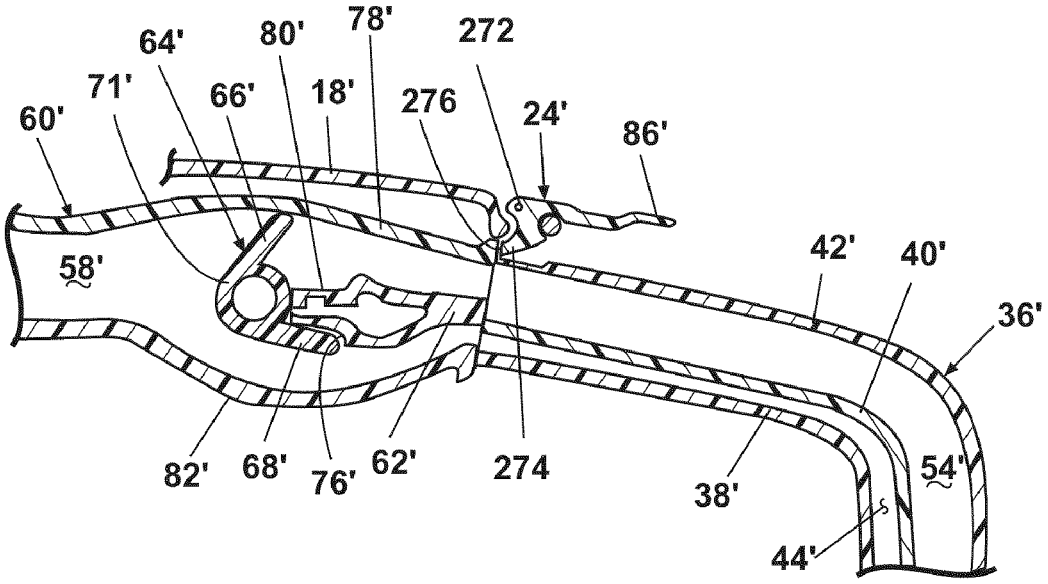
FIG. 12A is a sectional view taken along line 12A-12A of FIG. 11A.
Figure 12B:
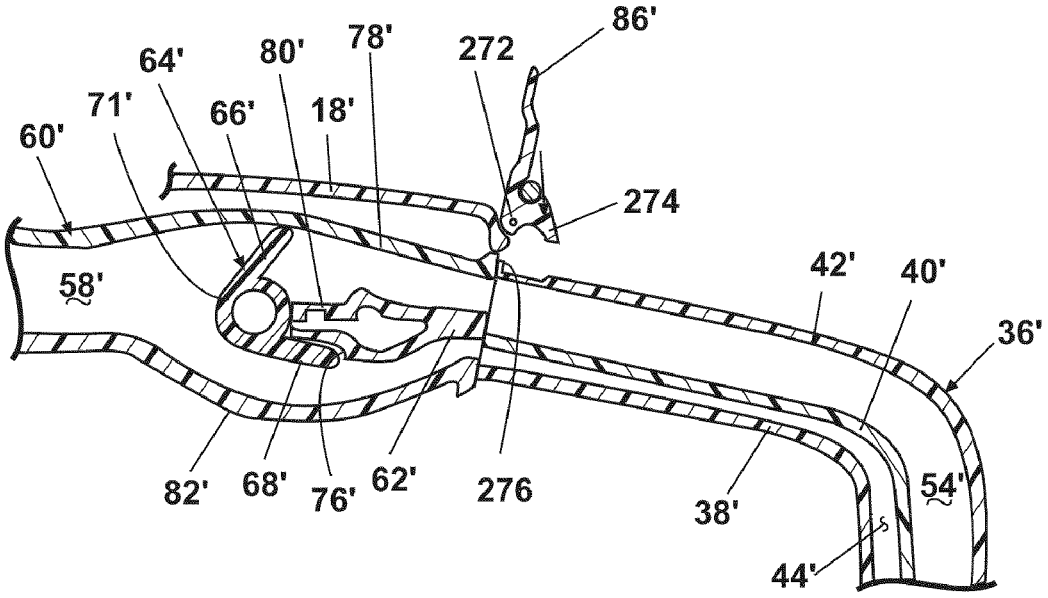
FIG. 12B is a sectional view taken along line 12B-12B of FIG. 11B.

Referring now to FIGS. 11A, 11B, 12A, and 12B, the latch 24' is a substantially planar member pivotally connected to the cover 18' of the housing 16'. The latch 24' comprises a forwardly extending handle 86', a rearwardly extending projection 270 with a pivot rod 272 extending therethrough, and a downwardly and rearwardly extending finger 274 located beneath the projection 270. When the latch 24' is in a locked position, as shown in FIGS. 11A and 12A, the finger 274 abuts an upwardly extending flange 276 on the top wall 42' of the nozzle assembly 36' to push the nozzle assembly 36' against the diverter housing 60' and thereby secure the nozzle assembly 36' to the base assembly 12'. The latch 24' is pivotable about the pivot rod 272 to an unlocked position, as shown in FIGS. 11B and 12B, wherein the finger 274 is spaced from the flange 276 on the top wall 42' of the nozzle assembly 36' so that the nozzle assembly 36' can be removed from the base assembly 12'. The latch 24' in the unlocked position remains in that position due to friction until a user applies downward force to the handle 86' to pivot the latch about the pivot rod 272 towards the base assembly 12'.

To remove the nozzle assembly 36' for cleaning or other purposes, a user grasps the handle 86' pivots the latch 24' about the pivot rod 272 from the generally horizontal, locked position to the generally vertical, unlocked position, thereby spacing the finger 274 from the flange 276. The user then simply pulls the nozzle assembly 36' from the base assembly 12'. To return the nozzle assembly 36', the user places the nozzle assembly 36' on the base assembly 12' so that the flange 276 on the top wall 42' of the nozzle assembly 36' abuts the diverter housing 60' while the latch 24' is in the unlocked position. Next, the user pivots the handle 86' to the locked position, whereby the finger 274 rotates to abut the flange 276 and thereby retain the nozzle assembly 36' on the base assembly 12'.

Figure 13:
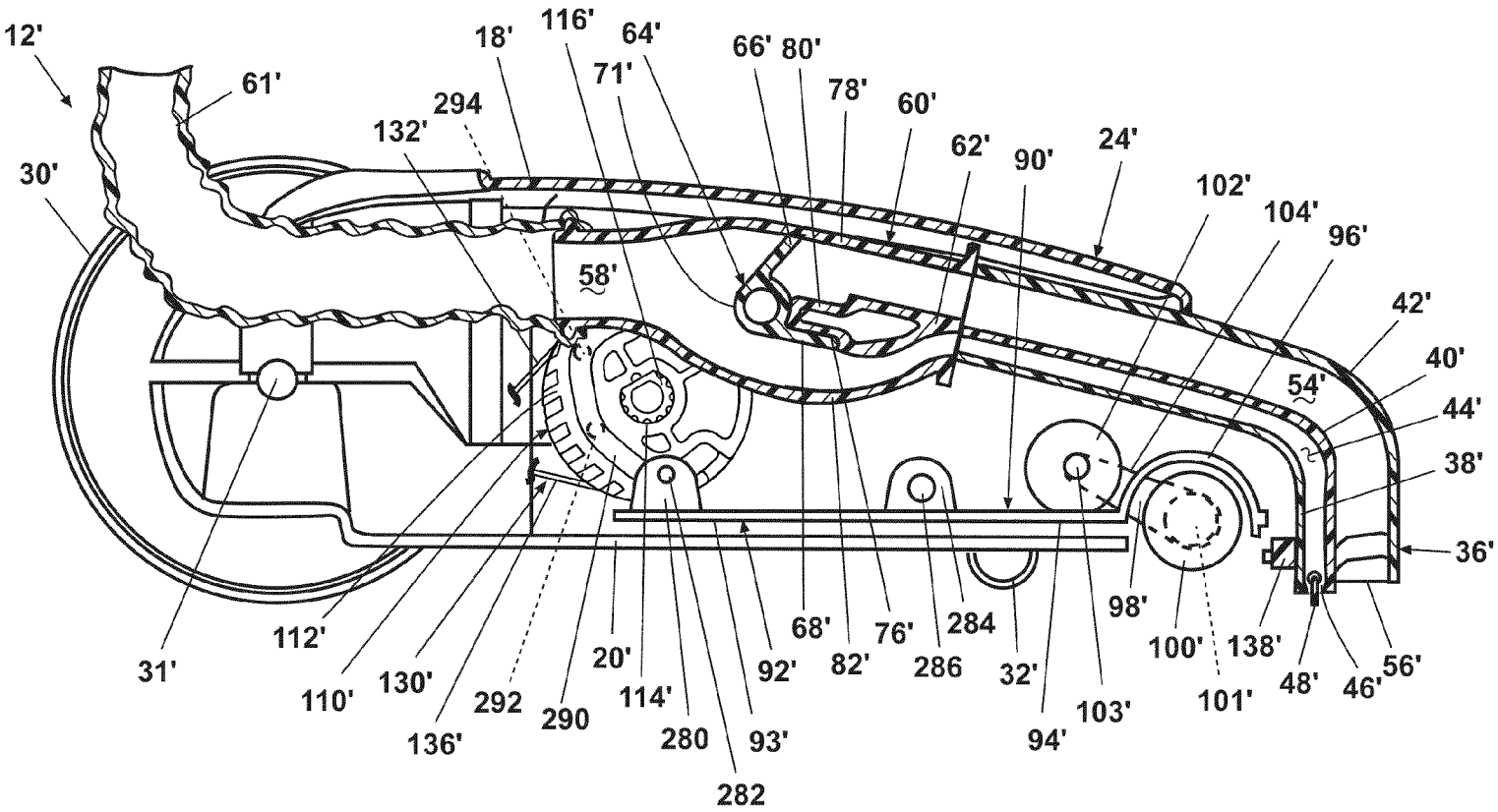
FIG. 13 is a sectional view taken along line 13-13 of FIG. 11A.

Referring now to FIG. 13, the agitator assembly 90' comprises a generally flat agitator platform 92' that is mounted to the base assembly 12' through a flange 284 and a central pivot pin 286 and has, at a forward portion 94', a generally semi-cylindrical, downwardly facing agitator cover 96' that forms an agitator chamber 98'. The platform 92' carries an agitator 100', preferably a rotatable horizontal axis brush, in the agitator chamber 98'. A motor 102' is positioned on the platform 92' adjacent the agitator cover 96' and drives the agitator 100'. The motor 102' and the agitator 100' are coupled by means of a conventional belt 104' disposed between a motor drive shaft 103' and an agitator pulley 101'. Two spaced upwardly extending tabs 280 are disposed at a rearward portion 93' of the platform 92' and a platform pin 282 extends along the entire width of the platform 92' between the two tabs 280'. The platform pin 282' is retained at its center by the cam assembly 110', which is mounted in the base housing 16'.

The cam assembly 110' comprises a generally circular cam 112' having a keyed center aperture 114' that is mounted on a keyed shaft 116'. The cam 112' comprises an irregularly shaped slot 290 that slidingly receives the platform pin 282. As the keyed shaft 116' and the cam 112' rotate, the platform pin 282 slides along the slot 290. Due to the irregular shape of the slot 290, the platform pin 282 moves up and down during rotation of the cam 112', thereby raising and lowering the rearward portion 93' of the platform 92'. When rearward portion 93' of the platform 92' moves up and down, the platform 92' pivots about the central pivot pin 286, thereby lowering and raising, respectively, the forward portion 94' of the platform 92' and, therefore, the agitator 100'. When the cam 112' drives the pin 282 upward, the agitator 100' is driven towards the surface to be cleaned. Conversely, the agitator 100' is raised from the surface to be cleaned when the cam 112' drives the pin 282 downward. Because the agitator 100' and agitator motor 102' are both mounted to platform 92', they are raised and lowered together, which simplifies connection of the belt 104' between the agitator 100' and the motor 102'.

Preferably, the slot 290 is shaped to alternate the agitator 100' between three positions: a first up position, a down position, and a second up position. FIG. 13 shows the agitator 100' in the first up position, raised from the surface to be cleaned. When the cam 112' rotates counterclockwise, relative to the orientation of the FIG. 13, the platform pin 282 slides within the slot 290 to a location labeled 292 (shown in phantom). When the cam 112' rotates to position the platform pin 282 at the location 292, the platform pin 282 is displaced upward whereby the agitator 100' simultaneously moves to the down position in contact with the surface to be cleaned. Further counterclockwise rotation of the cam 112' moves the platform pin 282 to a location labeled 294 and to move the agitator 100' to the second up position. Here, the platform pin 282 is lowered to a height equal to that of the first up position, and the agitator 100' is thereby raised from the surface to be cleaned.

Figure 14:
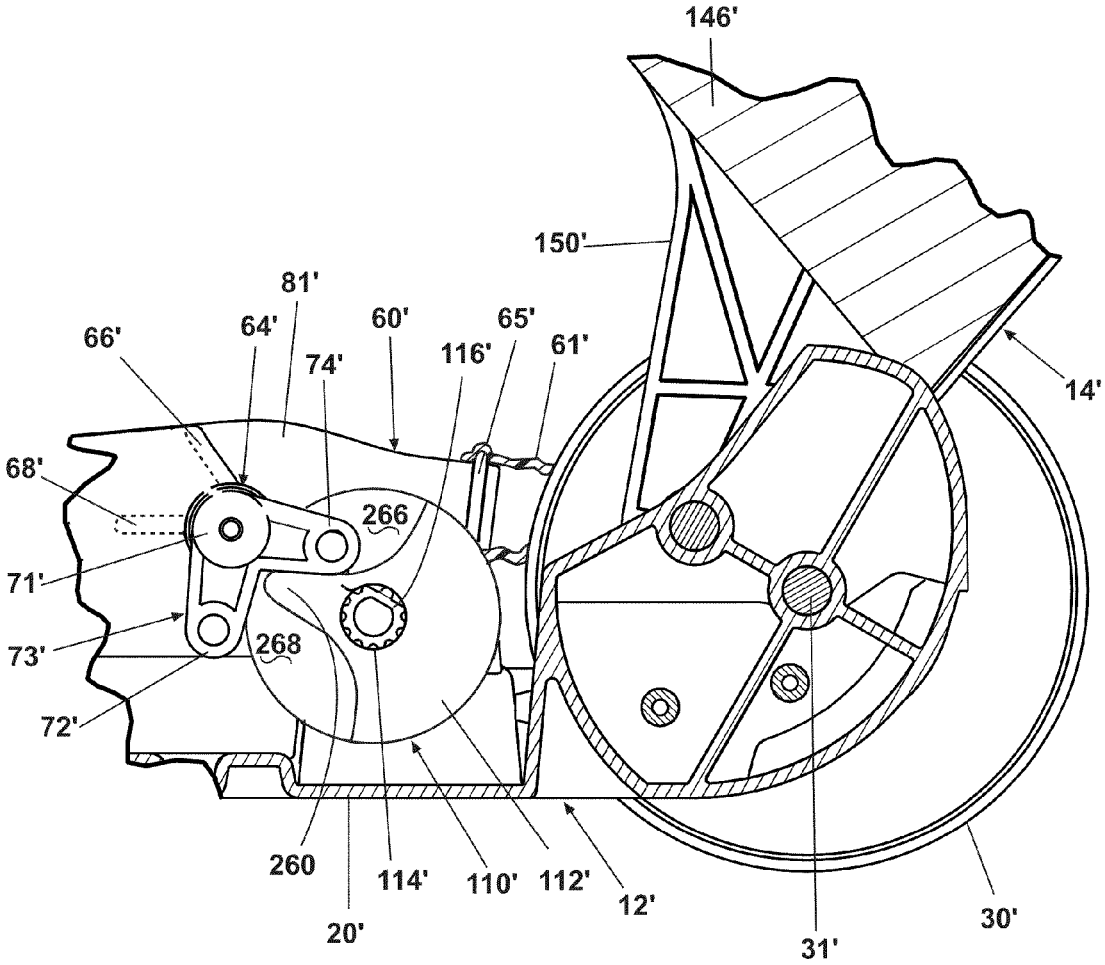
FIG. 14 is a partial sectional view taken along line 14-14 of FIG. 11A.

Referring now to FIG. 14, the cam assembly 110' further comprises means for rotating the diverter valve 64' between wet and dry modes. The cam 112' comprises, on one side thereof, a diverter cam member 260' that forms two grooves, an upper groove 266 and a lower groove 268. The lower groove 268 receives the first lever 72' of the control lever 73' of the diverter valve 64', and similarly, the second lever 74' of the control lever 73' is seated in the upper groove 266. The first and second levers 72', 74' are moveable within the lower and upper grooves 268, 266, respectively. As the keyed shaft 116' and the cam 112' rotate, the levers 72' and 74' are displaced by the diverter cam member 260' to thereby force the diverter valve 64' to pivot about its keyed shaft between the wet and dry modes.

Rotation of the cam assembly 110' to simultaneously control the positions of the agitator 100' and the diverter valve 64' is accomplished with a pull-pull cable controlled by an actuator in a manner similar to the first embodiment base assembly 12. The single actuator rotates the cam 112' between at least three positions: a first position wherein the agitator 100' is in the first up position and the diverter valve 64' is in the dry mode, a second position wherein the agitator 100' is in the down position and the diverter valve 64' is in the wet mode, and a third position wherein the agitator 100' is in the second up position and the diverter valve 64' is in the wet mode. The three positions of the cam 112' correspond to the dry pickup, wet scrubbing, and wet pickup operating modes.

Figure 15:
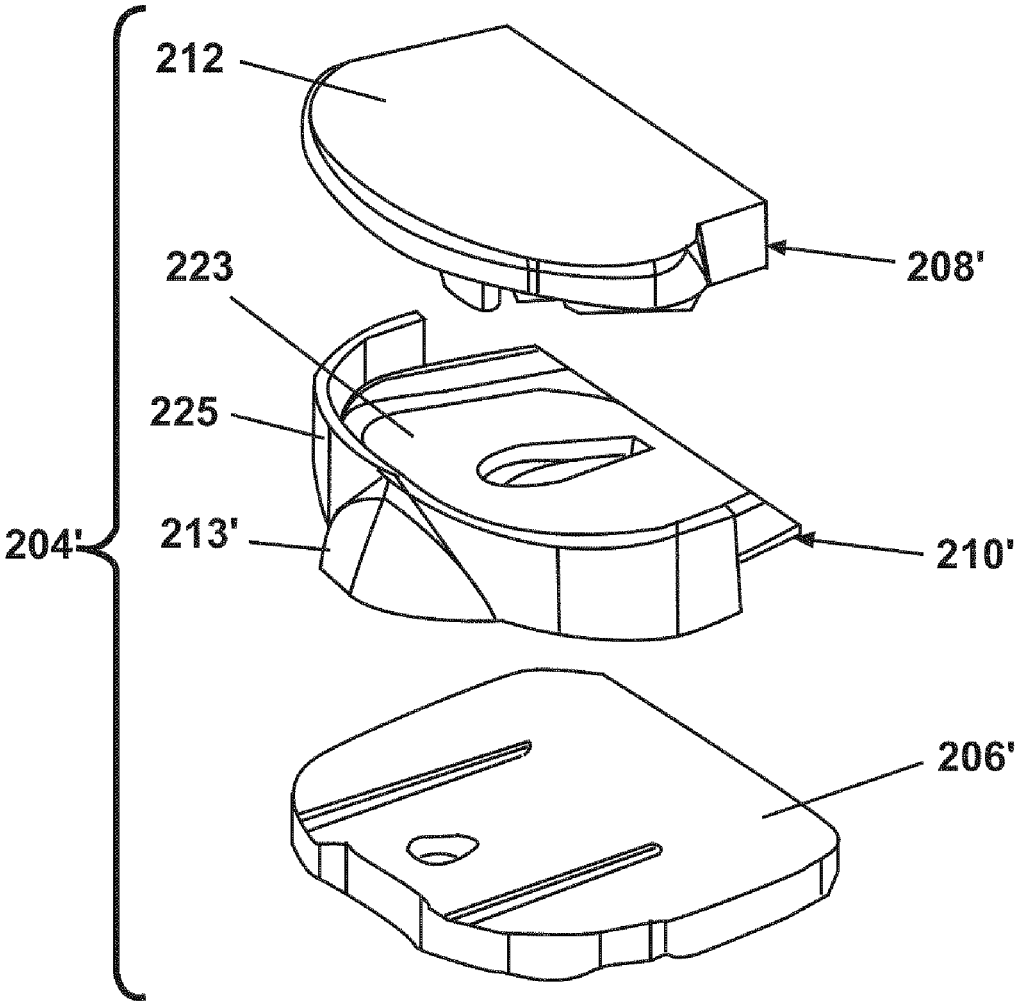
FIG. 15 is an exploded view of an alternative recovery tank latch assembly.
Figure 16:
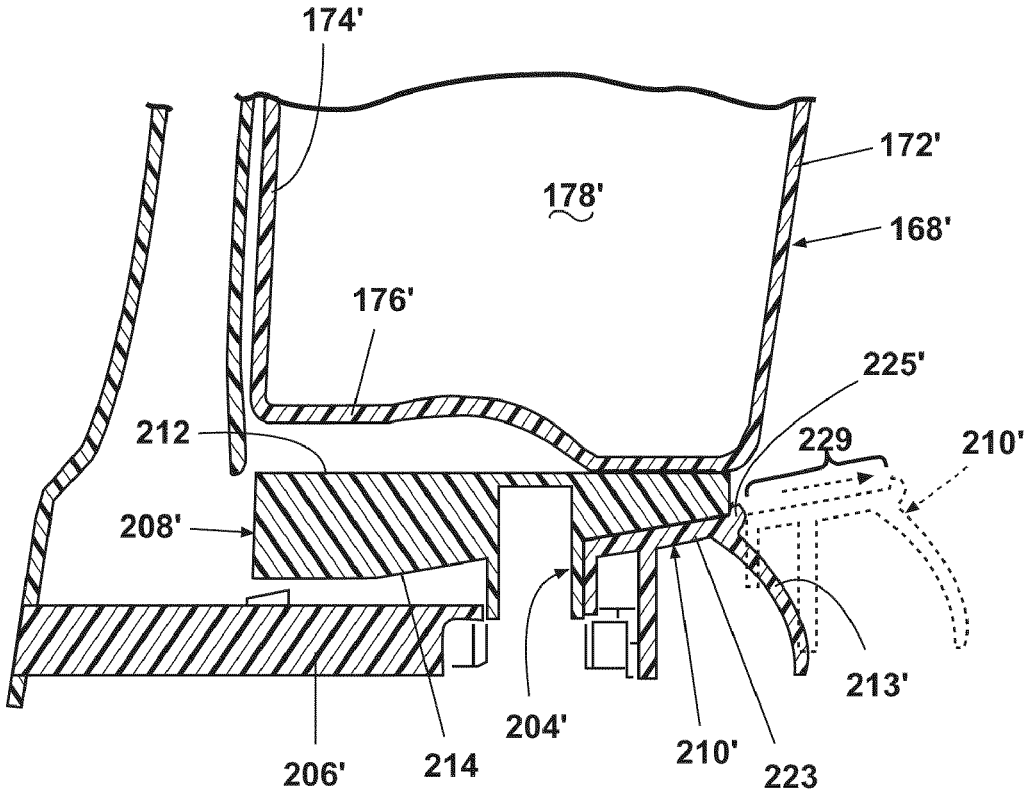
FIG. 16 is a sectional view of the recovery tank latch assembly in FIG. 15 and a recovery tank.

An alternative recovery tank latch assembly 204' for the bare floor cleaner 10 is illustrated in FIGS. 15 and 16, where like elements are identified with the same reference numeral bearing a prime (') symbol. The recovery tank latch assembly 204' is mounted to the spaced legs 146' of the lower handle 142' and supports the recovery tank assembly 162'. The recovery tank latch assembly 204' comprises a lower platform 206', an upper platform 208', and a slidable latch 210' therebetween. The upper platform 208' has an upper surface 212, which is generally parallel to the surface to be cleaned when the bare floor cleaner 10' is in the upright storage position, and a lower surface 214, which is inclined relative to the upper surface 212 such that the upper platform 208' is thicker at the rear than at the front. The slidable latch 210' is generally wedge-shaped and has an upper surface 223 that is inclined to mate with the inclined lower surface 214 of the upper platform 208'. The slidable latch 210' further comprises a latch handle 213' and an upwardly extending flange 225. When situated on the recovery tank latch assembly 204', the recovery tank 168' rests on the upper surface 212 of the upper platform 208' and is retained in place by lugs or recessed features (not shown) on the recovery tank 168' that engage with corresponding features (not shown) on the handle assembly 14'. In this position, the lid 180' abuts the filter assembly 170' with the seal 200' therebetween, and the recovery tank 168' is securely retained on the handle assembly 14'.

To remove the recovery tank assembly 162', a user pulls the slidable latch 210' forward by means of the latch handle 213', as shown in phantom in FIG. 16, such that a space 229 is created between the upwardly extending flange 225 and the recovery tank 168'. As the user slides the latch 210' forward, the recovery tank 168' falls downward and forward into the space 229 as the lid 180' separates from the filter assembly 170' at the seal 200'. Next, the user places a hand in the depressed region 190' behind the handle 188' of the recovery tank assembly 162', grasps the handle 188', and pulls the recovery tank assembly 162', including the tank 168' and the lid 180', forward for removal from the bare floor cleaner 10'.

To mount the recovery tank assembly 162' to the handle assembly 14', this removal process is generally conducted in a reverse order.

The bare floor cleaner 10 can alternatively comprise dual recovery tanks: a wet recovery tank for use when the diverter valve 64 is in the wet mode and a dry recovery tank that for use when the diverter valve 64 is in the dry mode. When the bare floor cleaner 10 comprises dual recovery tanks, the recovery system can include another diverter positioned between both outlets of the wet and dry recovery tanks and the motor and fan assembly 160 to direct the working air path through the desired recovery tank. In another alternate embodiment, the recovery tank 168 is divided into two separate compartments: one compartment to receive wet debris from the first or wet nozzle opening 46 and a second compartment to receive dry debris from the second or dry nozzle opening 56. In this embodiment, the diverter 64 is located downstream of the recovery tank assembly 162 and upstream of the motor and fan assembly 160 and can be actuated in a similar fashion as in the first embodiment to switch between wet and dry modes.

Furthermore, the nozzle assembly 36 can comprise a retractable squeegee 48 that can be manually raised from the surface to be cleaned. The user can manually retract the squeegee, such as when the bare floor cleaner 10 is in the dry pickup mode, to prevent undesirably transferring any residual liquid thereon to the surface to be cleaned.

Additionally, the invention has been disclosed with respect to a bare floor cleaner with an agitator in the form of a horizontal axis, rotatable brush. The term "agitator" is used herein in a broad sense to mean any type of implement that will scrub a bare floor and can include brushes, either stationary or movable with respect to the base assembly, fibrous or cloth pads, sponges, and the like.

The bare floor cleaner according to invention offers several advantages to a user. The cleaner is capable of performing, with one machine and without attachments, the several steps involved in effectively cleaning a bare floor surface. The agitator assembly, with the aid of fresh and optionally warm cleaning solution, proficiently removes dirt, dust, and debris adhered to the surface to be cleaned without requiring any physical exertion from a user. The cam assembly and diverter valve permit facile movement between dry pickup, wet scrubbing, and wet pickup modes with a single switch conveniently located on the handle assembly. The cleaning solution trigger is also disposed on the handle assembly; therefore, the operational controls of the bare floor cleaner can easily be accessed during use. Additionally, the recovery and supply tanks are easily removable from the handle assembly for quick emptying and filling, respectively. Further, any clogs that develop in the nozzle assembly are visible due to the shapes of the suction paths and the transparent nature of the nozzle walls, and the nozzle is quickly removable from the base assembly for removal of the clogs. Moreover, very little cleaning solution remains on the surface after wet pickup, with or without wet scrubbing. As a result, the surface readily dries and the room(s) can be used in a normal fashion.

The cleaning apparatus invention has been disclosed with respect to cleaning bare floors. However, the cleaner described herein can also be used on other floors and other surfaces, including carpets, upholstery, and the like, without departing from the scope of the invention. While the invention has been specifically described in connection with certain specific embodiments thereof, it is to be understood that this is by way of illustration and not of limitation. Reasonable variation and combination are possible with the scope of the foregoing disclosure without departing from the spirit of the invention, which is defined in the appended claims.

What is claimed is:

1. A floor cleaner capable of cleaning both wet and dry floor surfaces comprising:

a base assembly including a nozzle assembly adapted to remove debris from a surface to be cleaned in a dry suction mode and a wet suction mode and further including a switch mechanism for selectively converting the nozzle assembly from the wet suction mode to the dry suction mode and visa versa;

a handle connected to the base assembly for manipulating the base assembly across a surface to be cleaned;

a recovery tank carried by the handle;

a working air conduit extending from nozzle assembly to the recovery tank;

a motor/fan assembly mounted to one of the handle and the base and adapted to create a working air flow in the working air conduit from the nozzle assembly and to the recovery tank; and an actuator on the handle operably connected to the switch mechanism for selectively positioning the nozzle assembly in the dry suction mode and the wet suction mode.

2. The floor cleaner according to claim 1 wherein the base assembly further comprises an agitator movably mounted for movement between a first position wherein the agitator is adapted to agitate a surface to be cleaned and a second position wherein the agitator is spaced from the surface to be cleaned for selectively agitating the surface.

3. The floor cleaner according to claim 2 and further comprising an agitator mechanism for selectively controlling the movement of the agitator between the first and second positions.

4. The floor cleaner according to claim 3 wherein the actuator is connected to the agitator mechanism for selectively moving the agitator between the first and second positions.

5. The floor cleaner according to claim 4 wherein the actuator is a knob that is rotatably mounted to the handle.

6. The floor cleaner according to claim 5 wherein the actuator is connected to the agitator mechanism through a cable.

7. The floor cleaner according to claim 6 wherein the actuator is also connected to the switch mechanism through the cable.

8. The floor cleaner according to claim 4 wherein the agitator is a rotatable brush that is driven about an axis of rotation by a motor.

9. The floor cleaner according to claim 1 wherein the actuator is a knob that is rotatably mounted to the handle.

10. The floor cleaner according to claim 9 wherein the actuator is connected to the switch mechanism through a cable.

11. The floor cleaner according to claim 1 wherein the base assembly further comprises an agitator mounted to the base assembly and an agitator mechanism for selectively controlling movement of the agitator between a first position wherein the agitator is adapted to agitate a surface to be cleaned and a second position wherein the agitator is spaced from the surface to be cleaned for selectively agitating the floor surface, and the actuator is connected to the agitator mechanism for selectively moving the agitator between the first and second positions.

12. A floor cleaner for wet scrubbing and wet pick up comprising:

a base assembly including a nozzle adapted to remove moisture and debris from a surface to be cleaned, and an agitator for agitating the surface to be cleaned;

a handle connected to the base assembly for manipulating the base assembly across a surface to be cleaned;

a recovery tank;

a working air conduit extending from the nozzle to the recovery tank;

a motor/fan assembly mounted to one of the handle and the base and adapted to create a working air flow in the working air conduit from the nozzle and to the recovery tank;

the agitator is movable between a first position wherein the agitator is spaced from the surface to be cleaned and a second position wherein the agitator contacts the surface to be cleaned to agitate the surface to be cleaned;

an actuator mechanism for selectively controlling the movement of the agitator between the first and second positions; and an actuator knob rotatably mounted on the handle and operably connected to the actuator mechanism for selectively moving the agitator between the first and second positions.

13. The floor cleaner according to claim 12 wherein the actuator knob is connected to the actuator mechanism through a cable.

14. The floor cleaner according to claim 13 wherein the actuator knob is rotatable between first and second positions to move the agitator between the first and second positions.

15. The floor cleaner according to claim 14 wherein the actuator knob is also movable to a third position to move the agitator to the first position.

16. The floor cleaner according to claim 13 wherein the actuator mechanism comprises a rotatable cam such that movement of the cable by rotation of the actuator knob induces rotation of the cam.

17. The floor cleaner according to claim 16 wherein the agitator is mounted to a pivotal agitator platform operatively connected to the cam, whereby rotation of the cam pivots the agitator platform and thereby moves the agitator between the first and second positions.

18. The floor cleaner according to claim 12 wherein the agitator is a rotatable brush that is driven about an axis of rotation by a motor.

19. The floor cleaner according to claim 12 wherein the actuator knob is rotatable between first and second positions to move the agitator between the first and second positions.

20. The floor cleaner according to claim 19 wherein the actuator knob is also movable to a third position to move the agitator to the first position.

* * * * *